US009704464B1

(12) United States Patent
Petschulat

(10) Patent No.: US 9,704,464 B1
(45) Date of Patent: Jul. 11, 2017

(54) APPARATUS FOR ENHANCING OUTPUT OF A STRINGED MUSICAL INSTRUMENT

(71) Applicant: GTR NOVO LLC, Franklin, TN (US)

(72) Inventor: David J. Petschulat, Franklin, TN (US)

(73) Assignee: GTR NOVO LLC, Franklin, TN (US)

( * ) Notice: Subject to any disclaimer, the term of this patent is extended or adjusted under 35 U.S.C. 154(b) by 0 days.

(21) Appl. No.: 15/080,192

(22) Filed: Mar. 24, 2016

Related U.S. Application Data

(60) Provisional application No. 62/137,235, filed on Mar. 24, 2015.

(51) Int. Cl.
*G10H 3/00* (2006.01)
*G10H 3/18* (2006.01)

(52) U.S. Cl.
CPC ..... *G10H 3/181* (2013.01); *G10H 3/182* (2013.01); *G10H 3/183* (2013.01); *G10H 3/185* (2013.01); *G10H 2220/515* (2013.01); *G10H 2220/525* (2013.01)

(58) Field of Classification Search
CPC .... G10H 3/181; G10H 3/18; G10H 2220/525; G10H 1/00; G10H 1/46; G10H 3/182; G10H 3/186; G10H 1/32; G10H 2220/505; G10H 2220/515; G10H 3/143; G10H 3/183; G10H 2220/461; G10H 1/0556; G10F 1/16
See application file for complete search history.

(56) References Cited

U.S. PATENT DOCUMENTS

| | | | | |
|---|---|---|---|---|
| 2,964,985 A | | 12/1960 | Webster | |
| 3,177,283 A | | 4/1965 | Fender | |
| 3,249,677 A | | 5/1966 | Burns et al. | |
| 3,483,303 A | | 12/1969 | Warner | |
| 3,602,627 A | | 8/1971 | Mccammon | |
| 4,010,668 A | | 3/1977 | Plueddemann | |
| 4,096,780 A | | 6/1978 | Dawson | |
| 4,196,313 A | | 4/1980 | Griffiths | |
| 4,269,103 A | | 5/1981 | Underwood | |
| 4,364,295 A | | 12/1982 | Stich | |
| 4,377,101 A | | 3/1983 | Santucci | |
| 4,481,854 A | | 11/1984 | Dugas | |
| 4,524,667 A | * | 6/1985 | Duncan | G10H 3/181 84/728 |
| 4,854,210 A | | 8/1989 | Palazzolo | |

(Continued)

FOREIGN PATENT DOCUMENTS

| | | | |
|---|---|---|---|
| DE | 3437389 | A1 | 4/1986 |
| DE | 19705849 | A1 | 8/1998 |
| WO | 2009126799 | A2 | 10/2009 |

OTHER PUBLICATIONS

Kramer Ripley (Stereo Guitar, RSG-1) web site screen shots obtained Feb. 8, 2017 from http://www.guitar-list.com/kramer/electric-guitars/kramer-kramer-ripley-stereo-guitar-rsg-1.

(Continued)

*Primary Examiner* — Marlon Fletcher

(74) *Attorney, Agent, or Firm* — Lodestone Legal Group; Jeromye V. Sartain

(57) ABSTRACT

An apparatus for enhancing the output of a stringed musical instrument having a plurality of offset substantially parallel strings, the apparatus comprising a pickup assembly having tapered poles so as to incrementally vary the relative volume of adjacent strings.

34 Claims, 13 Drawing Sheets

(56) References Cited

U.S. PATENT DOCUMENTS

| | | | | |
|---|---|---|---|---|
| 5,029,511 | A | 7/1991 | Rosendahl | |
| D319,456 | S * | 8/1991 | Fender | D17/20 |
| 5,078,041 | A | 1/1992 | Schmued | |
| 5,111,728 | A | 5/1992 | Blucher et al. | |
| 5,292,998 | A | 3/1994 | Knapp | |
| 5,399,802 | A | 3/1995 | Blucher | |
| 5,525,750 | A | 6/1996 | Beller | |
| 5,530,199 | A * | 6/1996 | Blucher | G10H 3/181 84/728 |
| 5,557,058 | A | 9/1996 | Lace | |
| 5,610,357 | A | 3/1997 | Frank-Braun | |
| 5,744,744 | A | 4/1998 | Wakuda | |
| 5,811,710 | A * | 9/1998 | Blucher | G10H 3/181 84/728 |
| 5,894,101 | A | 4/1999 | Damm | |
| 5,908,998 | A * | 6/1999 | Blucher | G10H 3/181 84/723 |
| 5,949,014 | A | 9/1999 | Rashak et al. | |
| 6,103,966 | A * | 8/2000 | Kinman | G10H 3/181 84/728 |
| 6,162,984 | A | 12/2000 | Engard | |
| 6,346,661 | B1 | 2/2002 | Yaskoweak | |
| 6,372,976 | B2 | 4/2002 | Damm | |
| 6,525,258 | B1 | 2/2003 | Powers | |
| 6,992,243 | B2 | 1/2006 | Small | |
| 7,135,638 | B2 * | 11/2006 | Garrett | G10H 3/182 84/725 |
| 7,166,793 | B2 | 1/2007 | Beller | |
| 7,982,123 | B2 | 7/2011 | Mulvany | |
| 7,994,413 | B2 | 8/2011 | Salo | |
| 8,309,836 | B1 | 11/2012 | Bolger et al. | |
| 8,324,495 | B2 | 12/2012 | Jacob | |
| 8,415,551 | B1 | 4/2013 | Dixon | |
| 8,502,061 | B1 | 8/2013 | Alt | |
| 8,704,075 | B2 | 4/2014 | Gournis | |
| 8,853,517 | B1 | 10/2014 | Dixon | |
| 8,907,199 | B1 * | 12/2014 | Dixon | G10H 3/181 84/726 |
| 8,969,701 | B1 | 3/2015 | Dixon | |
| 8,993,868 | B2 | 3/2015 | Angelopoulos | |
| 9,018,509 | B2 | 4/2015 | Bialkowski et al. | |
| 9,064,483 | B2 | 6/2015 | Alt | |
| 9,147,387 | B2 | 9/2015 | Wolf et al. | |
| 2005/0150364 | A1 | 7/2005 | Krozack et al. | |
| 2005/0252363 | A1 | 11/2005 | Rockett | |
| 2006/0156911 | A1 | 7/2006 | Stich | |
| 2009/0255397 | A1 | 10/2009 | Mulvany | |
| 2010/0037746 | A1 * | 2/2010 | Medas | G10D 3/04 84/298 |
| 2010/0122623 | A1 * | 5/2010 | Salo | G10H 3/181 84/726 |
| 2011/0067556 | A1 | 3/2011 | Norman | |
| 2012/0118129 | A1 | 5/2012 | Jang | |
| 2014/0069264 | A1 | 3/2014 | Bialkowski et al. | |
| 2015/0053069 | A1 * | 2/2015 | Heil | G10H 3/181 84/726 |
| 2016/0196814 | A1 * | 7/2016 | Bath | G10H 3/183 84/727 |

OTHER PUBLICATIONS

Submarine Pickup web site screen shots obtained Feb. 8, 2017 from http://www.submarinepickup.com/.

* cited by examiner

APPARATUS FOR ENHANCING OUTPUT OF A STRINGED MUSICAL INSTRUMENT

RELATED APPLICATIONS

This is a non-provisional patent application under 35 U.S.C. §111 that claims priority pursuant to 35 U.S.C. §119(e) to and is entitled to the filing date of U.S. Provisional Patent Application Ser. No. 62/137,235 filed Mar. 24, 2015, and entitled "Method and Apparatus for Enhancing/Emphasizing Output of an Electric Stringed Musical Instrument." The contents of the aforementioned application is incorporated herein by reference.

BACKGROUND

The subject of this patent application relates generally to sound detection or amplification devices, and more particularly to apparatuses configured for enhancing the output of a stringed musical instrument.

Applicant hereby incorporates herein by reference any and all patents and published patent applications cited or referred to in this application.

By way of background, a conventional multi-stringed musical instrument (such as an electric or acoustic guitar) utilizes wire-wound magnetic pickups to convert the physical string vibrations into electrical signals for further amplification. Such pickups typically have additional adjustable magnetic elements ("pole pieces") under each string. On many pickups these pole pieces are individually adjustable, and adjusting these elements closer or further from their associated strings allows for control of the relative output volume of each string into the composite output signal. When adjusted properly, the overall volume of the instrument, when plucked or strummed, will give a perception that all strings are of "equal volume" and will thus produce a coherent listening experience. That is, no string or strings will sound uncharacteristically louder or softer than any other.

After such adjustments have been made, there are still situations during performances or recording where modifications of the instrument's sound are desired. The most common modifications are currently done by changing the frequency characteristics of the outputted waveform by using equalization (EQ) via electronic filtering. For example, emphasizing the low-range frequencies of a guitar may be achieved by "rolling off" the higher frequencies to give the instrument a "fatter" sound. However, such filtering removes not only the upper harmonics of the emphasized notes but also removes much of the frequencies of the higher notes—often an undesirable result.

One objective of this invention is to provide a method of emphasizing certain aspects of the output of a stringed musical instrument while retaining the characteristic sounds of the emphasized string or strings. A second objective of this invention is to achieve said emphasis using string group coil outputs. A third objective of this invention is to integrate the emphasis into the overall sound of the instrument. And a fourth objective of this invention is to emphasize the selected string or strings without compromising the sound of the non-emphasized string or strings.

Aspects of the present invention fulfill these needs and provide further related advantages as described in the following summary.

SUMMARY

Aspects of the present invention teach certain benefits in construction and use which give rise to the exemplary advantages described below.

The present invention solves the problems described above by providing an output enhancing apparatus that provides a descending array in volume of adjacent strings within a set or subset of strings. In at least one embodiment, an apparatus according to aspects of the present invention for enhancing the output of a stringed musical instrument having a plurality of offset substantially parallel strings comprises a pickup assembly having tapered poles so as to incrementally vary the relative volume of adjacent strings.

According to a further aspect, the pickup assembly comprises both tapered and non-tapered poles, the non-tapered poles configured so as to produce substantially the same volume from adjacent strings.

According to a still further aspect, the non-tapered poles are positioned within at least one full coil configured to have one pole associated with each of the plurality of strings, and the tapered poles are positioned within at least one partial coil configured to have one pole associated with each of a subset of the plurality strings, the subset being fewer than the plurality of strings.

According to a still further aspect, the tapered poles taper toward center strings of the plurality of strings.

According to a still further aspect, the tapered poles are tapered by physically setting the heights of pole pieces defining the poles in a descending array relative to associated strings of the plurality of strings.

According to a still further aspect, the tapered poles are tapered by adjusting the output volumes of piezo crystal elements installed within a bridge of the stringed musical instrument so as to be associated with the plurality of strings and define the pickup assembly and the related tapered poles in a descending array as through a potentiometer.

According to a still further aspect, the tapered poles are tapered by selecting a subset of frequencies through a capacitor and adjusting the amount of frequency filtering as through a connected potentiometer.

According to a still further aspect, the tapered poles are positioned within a single pickup assembly comprising two partial coils each configured to have one pole associated with each of a subset of the plurality strings, the subset being fewer than the plurality of strings.

According to a still further aspect, the apparatus comprises multiple pickup assemblies, at least one such pickup assembly having tapered poles.

According to a still further aspect, the apparatus comprises a first pickup assembly comprising a first full coil having first non-tapered poles associated with each of the plurality of strings and a first partial coil having first tapered poles associated with each of a first subset of the plurality strings, the first subset being fewer than the plurality of strings and a second full coil having second non-tapered poles associated with each of the plurality of strings and a second partial coil having second tapered poles associated with each of a second subset of the plurality strings, the second subset being fewer than the plurality of strings, wherein the first and second subsets of the plurality of strings are different.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments, though it will be appreciated that analogous features may also be referenced by different numerals in the various views as set forth in the detailed description.

DETAILED DESCRIPTION

Aspects of the present invention are generally directed to an apparatus configured for enhancing the output of a stringed musical instrument. As a threshold matter, it will be appreciated that while the exemplary such stringed musical instrument is an electric or perhaps acoustic guitar having six strings, a wide variety of other stringed instruments and related variations of the exemplary apparatus are possible according to aspects of the present invention without departing from its spirit and scope. Furthermore, it will be appreciated with respect to all the figures illustrating the apparatus or components thereof that such are schematic in nature and in any case are not to be taken to scale or as an indication of the absolute or proportional size of any features of the invention. No dimensional or material call-outs are intended or inferred unless set forth specifically. The output enhancing apparatus generally comprises at least one pickup assembly, which it will be appreciated from the following detailed description make take many forms in beneficially allowing for or enabling the enhanced output of a set or subset of strings in a relatively coherent or blended fashion, providing great flexibility in "mixing" sounds from the instrument in a pleasing way.

Figure 1A:
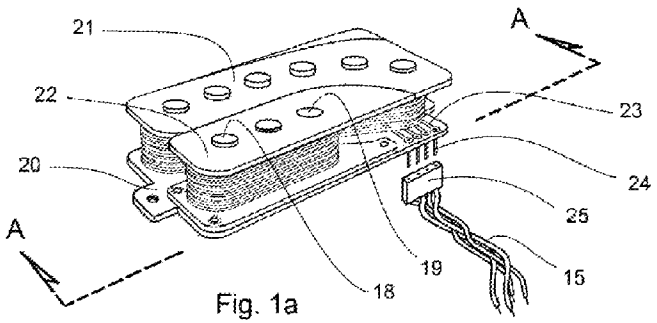
FIG. 1*a* is a perspective view of an exemplary output enhancing apparatus including full and partial electromagnetic coils defining a pickup assembly, in accordance with at least one embodiment.

Turning now to FIG. 1*a*, there is shown a perspective view of an exemplary embodiment of an output enhancing apparatus according to aspects of the present invention comprising a pickup assembly having one conventional electromagnetic coil, here associated with six strings and thus having six poles, and one partial electromagnetic coil with descending pole pieces, here across three strings, though it will be appreciated that partial coils addressing any number of strings or having any number of poles are possible, such that the three-pole partial coil and any other three-, four- or five-pole partial coil or other such coil shown and described herein is to be understood as merely illustrative of features and aspects of the present invention and non-limiting. More particularly, there is shown a pickup assembly having an assembly plate 20 upon which are attached electromagnetic coils 21 and 22. Full coil 21 contains ferromagnetic pole pieces arrayed such that one pole will be positioned below each of the stringed instrument's strings, in this case six, and the heights of the poles are arranged to provide the perception of equal amplitude in phons across all six strings. All such heights of poles and the like shown and described herein are to be understood as merely illustrative and non-limiting and as depicted may effectively be exaggerated for ease of illustration and viewing. Once again, no such drawings are to be taken literally or to scale. Partial coil 22 is an electromagnetic pickup coil which is shorter in length than full coil 21, here spanning only three of the instrument's six strings, and it contains ferromagnetic pole pieces which are arranged in a descending array to produce progressively diminished string amplitude in phons from a high phon value at high pole 18 at an outer string of the instrument, and descending to low phon value at low pole 19 at one of the instrument's inner strings (i.e., the last of the strings associated with the partial coil 22). More generally, it is to be understood that all such "poles" and "pole pieces" referred to herein, while depicted as conventional cylindrical pieces of ferromagnetic material in the electromagnetic coil context, may take any form or be made of any appropriate material now known and later developed, as will be further appreciated from FIGS. 4 and 5 discussed below; moreover, in other contexts the "poles" may not even be ferromagnetic or other such material pieces, but may instead comprise other technologies and related materials now known or later developed by which the relative volume of adjacent strings may be set in a descending array. As such, "poles" may be individual pole pieces, points on a continuous pole piece, or other points associated with individual strings by which a signal based on the vibration of any such associated string is detected. Continuing with the exemplary embodiment of FIG. 1*a*, assembly plate 20 has etched upon it electrical traces with pads 23 through which are soldered pins 24. The opposite ends of the traces 23 which pertain to coil 21 have pads (not shown) to which the wires of coil 21 are attached. The traces 23 which pertain to coil 22 are shown and described in connection with FIG. 2, below. Pins 24 insert into connector jack 25 to connect electrical lead wires 15 to the coils 21 and 22. While the full coil 21 and partial coil 22 are shown as being nested or immediately adjacent each other on a single assembly plate 20, more about which is said below regarding FIG. 2, it will be appreciated by those skilled in the art that any such full and partial coils 21 and 22 need not be mounted on the same assembly plate or even be immediately adjacent as shown.

Figure 1B:
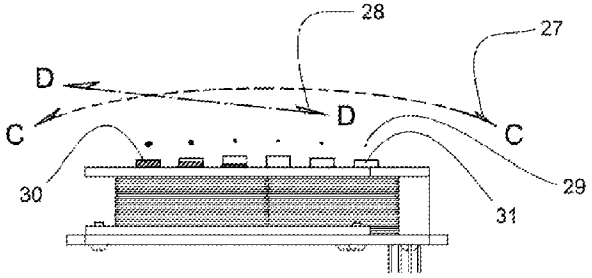
FIG. 1*b* is a front view thereof taken from datum A-A of FIG. 1*a*, in accordance with at least one embodiment.

In FIG. 1*b* there is shown a profile or front view of the apparatus of FIG. 1*a* taken along datum line A-A to better view the pole arrangements or heights of both the full and partial coils 21 and 22 of FIG. 1*a*. The smallest diameter string 29 of the instrument through the largest diameter string are shown in cross section or as an along-axis view in an arced array as is typical of musical instruments such as guitars, approximately parallel to arced datum line C-C denoted by reference numeral 27. Also parallel to datum C-C are points along the tops of the ferromagnetic poles of the rear coil as viewed (correlating to full coil 21 of FIG. 1*a*) which end at pole 31 beneath the smallest string 29, where the poles of the full coil 21 will have relatively consistent output volume across all six strings in such a conventional arrangement. Datum D-D denoted by reference numeral 28 descends toward the lengthwise middle of the instrument strings, and parallel to datum D-D are points along the tops of the poles of the front or partial coil as viewed (correlating to partial coil 22 of FIG. 1*a*) which start at pole 30, where the poles of the partial coil 22 will have successively less output volume from the strings progressing beneath datum D-D and progressing toward the center of the strings (correlating to poles 18 through 19 of FIG. 1*a*). Those skilled in the art will appreciate that both the number and overall configuration of the pole pieces and the actual physical height of the individual poles or the degree of their taper or variance in height from one to the other are merely illustrative and non-limiting, again noting that none of the figures are to be taken literally or to scale in terms of actual or relative size or dimension.

Figure 2:
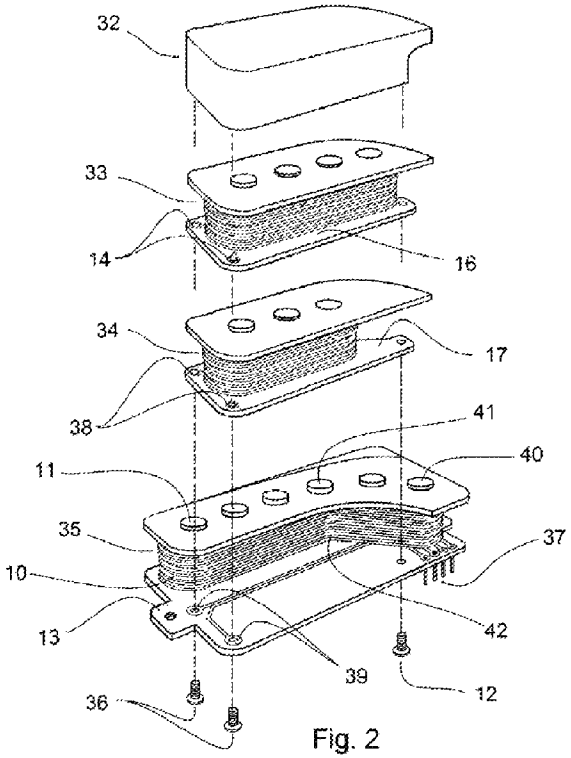
FIG. 2 is an exploded perspective view of the illustrated embodiment of FIGS. 1*a* and 1*b*, in accordance with at least three embodiments.

FIG. 2 shows an exploded perspective view of the pickup assembly of FIG. 1*a* wherein in alternative embodiments the three-pole partial coil 34 (correlating to partial coil 22 of FIG. 1*a*, whether or not tapered) is replaceable with a four-pole partial coil 33 or a non-coil cover 32 within the overall assembly. That is, as shown, with partial coil 34 detached, there are two additional attachable options: an alternate partial coil 33 having four ferromagnetic poles configured to span four of the instrument strings; and an alternate non-coil cover 32 that can be installed in lieu of a coil subassembly. The removal of the initial three-pole partial coil 34 exposes etched electrical traces which run across assembly plate 13 to connect multiple of pins 37 to electrical pads 39. Attachment screws 36 pass through assembly plate 13 and into mating electrical pads 38 on the base plate 17 of the three-pole partial coil 34, or mating electrical pads 14 on base plate 16 of the alternative four-pole partial coil 33, to complete the wiring circuit of either such attached coil subassembly to pins 37. If no coil subassembly is desired, non-coil cover 32 may alternately be secured with screws 36. Non-coil cover 32 may have two mating electrical pads (not shown) connected by an electrical trace (not shown), that when attached to base plate 13 may short-circuit electrical pads 39 and associated pins 37. Any of these attachable elements 34, 33, or 32 may also be secured by other screws which are not part of the electrical circuit like screw 12 or employing any other such fasteners in configuration or number, now known or later developed. In similar manner to which the shown alternate subassemblies may be attached and electrically connected to base assembly plate 13, other subassemblies may also be provided according to aspects of the present invention which employ one or more different string sensing apparatuses, but which may similarly be attached and electrically connected. The representative full coil 35 of the pickup assembly has pole pieces 11, 41 and 40 arranged in a non-straight or curved formation to allow for the lengthwise elongation of the respective coil wire winding 10 of the full coil 35 between poles 11 and 40. The elongate coil wire winding 10 may further have an intermediate bend 42 formed therein to accommodate the overall elongation and to provide clearance for situating additional coil subassemblies 34 or 33 upon the base assembly plate 13 to form the finished pickup assembly with the full and partial coils effectively nested on the plate 13.

Figure 3A:
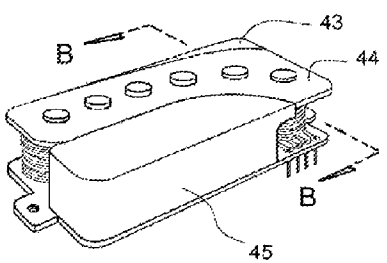
FIG. 3*a* is a perspective view of an alternative exemplary output enhancing apparatus including a full electromagnetic coil defining a pickup assembly, in accordance with at least one embodiment.
Figure 3B:
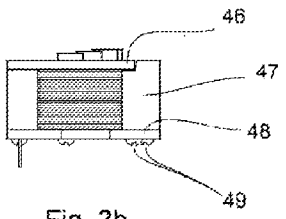
FIG. 3*b* is a side view thereof taken from datum B-B of FIG. 3*a*, in accordance with at least one embodiment.

Referring briefly to FIGS. 3*a* and 3*b*, there are shown perspective and side views of an alternative pickup assembly similar to that of FIG. 2 with the non-coil cover 32 attached. As best seen in FIG. 3*a*, a pickup assembly like pickup assembly 35 of FIG. 2 includes a non-coil cover 45 attached (correlating to cover 32 of FIG. 2). Top stabilizer 43 is shown adjacent to the full coil top plate 44, which provides support thereto. FIG. 3*b* shows an end view from datum line B-B of FIG. 3*a* to better view how top stabilizer 47 (correlating to top stabilizer 43 in FIG. 3*a*) is positioned to support the full coil top plate 46 (correlating to top plate 44 in FIG. 3*a*). The ledge in stabilizer 47 upon which plate 46 rests supports the top from being tilted downward. The ledge could alternately be undercut and the edge of the plate feathered or notched so that the top might interlock with the ledge to inhibit tilting in either a downward or upward direction. In the exemplary embodiment, the stabilizer 47 is secured to assembly plate 48 by attachment screws 49, though in an alternate embodiment might instead be inserted between a coil top plate and a coil bottom plate and secured to each with screws or other fasteners to stabilize the coil top and bottom plates. It will be appreciated that any other such structure now known or later developed may be employed in providing support to any such top plate associated with one or more coils of a pickup assembly according to aspects of the present invention.

Figure 4A:
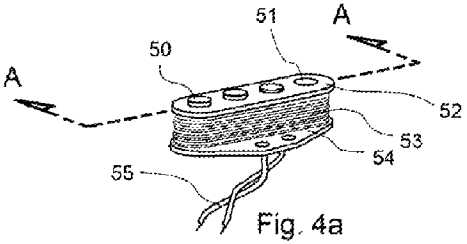
FIG. 4*a* is a perspective view of an exemplary partial electromagnetic coil as may be employed within a pickup assembly of an output enhancing apparatus, in accordance with at least one embodiment.

Turning next to FIG. 4*a*, there is shown an exemplary individual partial coil assembly which achieves progressively diminished amplitude for an array or set or subset of strings of a musical instrument (not shown). As a threshold matter, it is noted that while the assembly of FIG. 4*a* is characterized as "partial," that is only the case based on the exemplary six-string instrument context. If the instrument had four strings, the assembly depicted in FIG. 4*a* would then be a tapered "full coil" or "full set." Similarly, the assembly shown and any other such pickup assemblies herein can simply be scaled by effectively lengthening or shortening them, or in the case of electromagnetic coils by adding or removing pole pieces or other such ferromagnetic material, to render such assemblies "full" or "partial" as desired, whereby as will be appreciated from the further exemplary embodiments shown and described herein, output enhancement apparatuses and related one or more pickup assemblies may comprise a non-tapered or tapered full coil or set, a tapered or non-tapered partial coil or subset, or any combination of one or more such full or partial coils; the same is true for non-electromagnetic coil embodiments such as those employing piezo crystal elements, for example. Continuing with the exemplary embodiment of FIG. 4*a*, the coil assembly has a top plate 52, an array of four ferromagnetic pole pieces and a bottom plate 54. The pole pieces are arranged in a progressively descending array with pole 50 being the highest positioned and pole 51 being the lowest positioned with respect to the musical instrument strings. Between the top and bottom plates and around the poles is wire winding 53, the ends of which attach to the electrical leads 55.

Figure 4B:
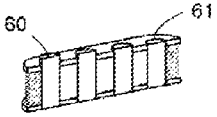
FIG. 4*b* is a perspective cross-sectional view taken along datum A-A of FIG. 4*a* of an exemplary electromagnetic coil, in accordance with at least one embodiment.
Figure 4C:
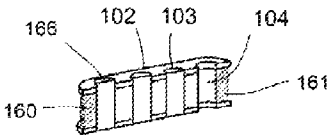
FIG. 4*c* is a perspective cross-sectional view taken along datum A-A of FIG. 4*a* of a further exemplary electromagnetic coil, in accordance with at least one embodiment.
Figure 4D:
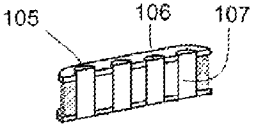
FIG. 4*d* is a perspective cross-sectional view taken along datum A-A of FIG. 4*a* of a still further exemplary electromagnetic coil, in accordance with at least one embodiment.

FIGS. 4*b*-4*d* are perspective cross-sectional views taken along datum A-A of FIG. 4*a* showing various exemplary partial electromagnetic coil configurations, particularly in terms of the poles, showing four descending poles, three descending poles and an empty hole, or three descending poles and a non-ferromagnetic slug, respectively. First, FIG. 4*b* shows a cross-section of the partial coil of FIG. 4*a*, wherein the exemplary four pole pieces descend from the highest pole 60 to the lowest pole 61. FIG. 4*c* shows an alternative partial coil wherein three poles descend from the highest pole 166, through pole 102, to the lowest pole 103, after which is another hole 104 which is empty. The coil winding in cross section, denoted 160 adjacent the highest pole 166 and 161 adjacent the empty hole 104, thereby encompass pole 166 to hole 104, including intermediate poles 102 and 103. With no ferromagnetic pole in hole 104 for assistance in sensing the associated string, the winding 161 near hole 104 will produce the weakest output possible, and thus if weak output is desired, no pole may be wanted in hole 104. FIG. 4*d* is similar to FIG. 4*c*, depicting a partial coil also with a highest pole 105 and a lowest pole 106; however, rather than leaving a hole at the end of the coil like hole 104 in FIG. 4*c*, the partial coil of FIG. 4*d* has a non-ferromagnetic slug 107 occupying the last hole in the array. Since the slug 107 would not assist in sensing the string, slug 107 would produce the weakest output possible for the coil, in similar fashion to hole 104 in FIG. 4*c*. It will again be appreciated that the number and arrangement of poles, holes, or slugs and the actual physical height of the individual poles or the degree of their taper or variance in height from one to the other are merely illustrative and non-limiting of aspects of the present invention.

Figure 5A:
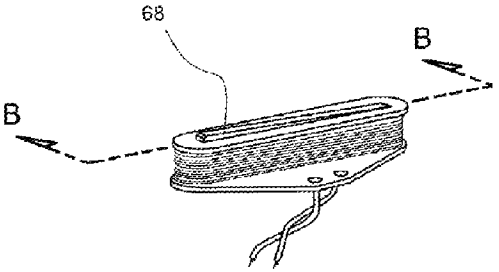
FIG. 5*a* is a perspective view of a further exemplary partial electromagnetic coil as may be employed within a pickup assembly of an output enhancing apparatus, in accordance with at least one embodiment.
Figure 5B:
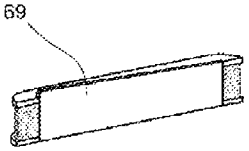
FIG. 5*b* is a perspective cross-sectional view taken along datum A-A of FIG. 5*a* of an exemplary electromagnetic coil, in accordance with at least one embodiment.
Figure 5C:
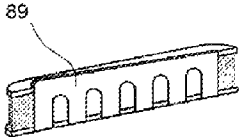
FIG. 5*c* is a perspective cross-sectional view taken along datum A-A of FIG. 5*a* of a further exemplary electromagnetic coil, in accordance with at least one embodiment.

Turning briefly to analogous FIGS. 5*a*-5*c*, there are shown an alternative exemplary individual partial coil assembly which achieves progressively diminished amplitude for an array or set or subset of strings of a musical instrument (not shown), here through employing a blade or plate 68 or the like defining the "tapered poles," such plate 68 again being tapered from one end to the other of an associated set or subset of strings as desired. Fundamentally, it will be appreciated that in the electromagnetic coil context any configuration of ferromagnetic material, again whether as an array of individual pole pieces or as an effective single or unitary pole piece that is either shaped or oriented so as to be tapered or any other such configuration or arrangement is possible according to aspects of the present invention, whereby in any such embodiment there is formed or configured in or by the output enhancement apparatus and related at least one pickup assembly a descending array in volume of adjacent strings based on the proximity of each such string to the ferromagnetic or other such material beneath or associated with the respective string for the detection of vibration. Accordingly, those skilled in the art will appreciate that an apparatus according to aspects of the present invention may take a number of forms beyond those shown and described without departing from the spirit and scope of the invention. Here, the alternative exemplary coil assembly has a single ferromagnetic plate 68 arranged lengthwise within the assembly so as to have a high end or pole and an opposite low end or pole, the plate 68 thus replacing the four individual pole pieces 50 through 51 of the coil of FIG. 4*a*, whereby an effective array of four ferromagnetic poles associated with four strings, again whether as a set or subset of strings of the instrument (not shown), is thus provided so as to have varying distances or spaces between the poles or points along the top edge of the plate 68 and the respective strings so as to incrementally vary the volume between adjacent strings along the coil assembly. Once again, between the top and bottom plates and around the poles, here defined by the pole plate 68, is a wire winding with its ends attached to electrical leads. FIGS. 5*b* and 5*c* then show in schematic cross-section taken from datum B-B of FIG. 5*a* two alternative embodiments of the pole plate 68, as either having a substantially solid wall 69 having a tapered upper edge (FIG. 5*b*) or a similar tapered wall 89 with associated pits or voids so as to configure the alternative plate 89 as having legs or tines; it will be appreciated that the number of such voids and tines may vary and need not directly correlate to the number or positions of associated strings. Again, a variety of other such configurations of poles as being separately or integrally formed within a coil assembly or the like are possible according to aspects of the present invention without departing from its spirit and scope.

Figure 6:
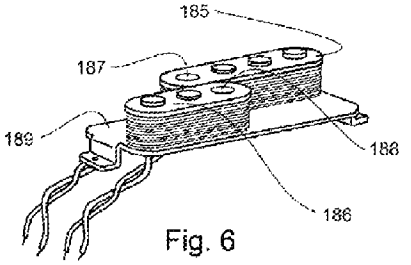
FIG. 6 is a perspective view of an alternative exemplary two partial electromagnetic coils as may be employed within a pickup assembly of an output enhancing apparatus, in accordance with at least one embodiment.

Referring now to FIG. 6, there is shown a further exemplary pickup assembly according to aspects of the present invention, here having one partial electromagnetic coil with descending pole pieces across four strings and one electromagnetic coil with descending pole pieces across three strings so as to overlap and taper. More particularly, in the illustrated embodiment, FIG. 6 shows a pickup assembly for a six-stringed musical instrument such as a guitar, consisting of two coils each of which spans a subset of the strings together mounted on a base plate 189. Partial coil 185 spans four strings with ferromagnetic pole pieces in a descending array with pole 187 being lowest in height and hence string amplitude toward the instrument's inner strings. And partial coil 186 spans three strings with ferromagnetic pole pieces in a descending array with pole 188 being lowest in height and hence string amplitude, also toward the instrument's inner strings. As shown, the opposed and overlapping partial coils 185 and 186 thus each taper lower inwardly or from the outermost respective strings toward the middle strings, thereby allowing for a unique though still coherent enhancement of the overall string set of the instrument.

Figure 7:
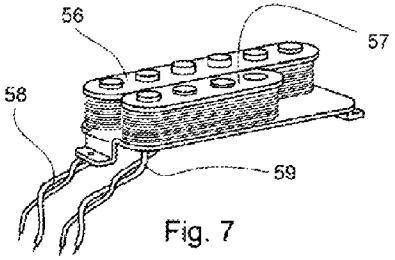
FIG. 7 is a perspective view of a further alternative exemplary full and partial electromagnetic coils as may be employed within a pickup assembly of an output enhancing apparatus, in accordance with at least one embodiment.

Similarly, in the perspective view of FIG. 7, a further alternative exemplary pickup assembly is shown having one conventional full electromagnetic coil and one partial electromagnetic coil with descending pole pieces across or associated with four strings. Particularly, FIG. 7 shows an assembly having a four-pole partial coil 57 with electrical leads 59, being similar to the partial coil 52 shown in FIG. 4, and having an additional conventional full coil 56 with electrical leads 58. FIG. 7 is simpler in some respects but comparable to the pickup assembly described in FIG. 1*a*, further noting the four-pole partial coil of FIG. 7 compared with the three-pole partial coil 22 in FIG. 1*a* Again, those skilled in the art will appreciate that a variety of arrangements and numbers of poles and coils comprising any particular pickup assembly and hence output enhancing apparatus are possible according to aspects of the present invention without departing from its spirit and scope, such that all such illustrated embodiments are to be understood as exemplary and non-limiting.

Figure 8:
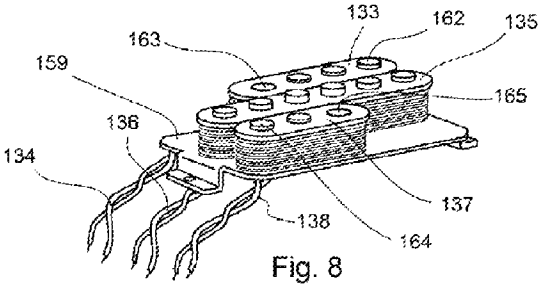
FIG. 8 is a perspective view of an alternative exemplary full and two partial electromagnetic coils as may be employed within a pickup assembly of an output enhancing apparatus, in accordance with at least one embodiment.

FIG. 8 shows a further alternative exemplary pickup assembly having one conventional full electromagnetic coil, one partial electromagnetic coil with descending pole pieces across four strings, and one electromagnetic coil with descending pole pieces across three strings. The alternative pickup thus comprises an assembly of three coils on a base plate 159, having one conventional full coil 135 that spans all the musical instrument strings and two more partial coils which span only a subset of the strings. As shown, partial coil 133 spans four strings with ferromagnetic pole pieces in a descending array with pole 162 highest in height and amplitude at the outer string and pole 163 lowest in height and amplitude near the center strings. And partial coil 137 spans three strings with pole pieces in a descending array with pole 164 highest in height and amplitude at the outer string and pole 165 lowest in height and amplitude near the center strings. The assembly has separate electrical leads for each of the three coils: leads 134 for coil 133, leads 136 for coil 135, and leads 138 for coil 137. Accordingly, the opposed and overlapping partial coils 133 and 137 thus each taper lower inwardly or from the outermost respective strings toward the middle strings, here as balanced by or added to the frequencies detected by the full coil spanning all six strings, thereby allowing for further unique, coherent enhancement of the overall string set of the instrument. Though shown as having the full coil 135 centered on the base assembly plate 159 with the two partial coils 133 and 137 on opposite sides of or flanking the full coil 135, it will be appreciated that such arrangement is not required and the full coil 135 could be on one side or along one edge of the plate 159 with the partial coils adjacent each other. Again, all such arrangements, including having one or more such full or partial coils mounted on separate plates or otherwise being spaced apart rather than substantially adjacent, are possible according to aspects of the present invention without departing from its spirit and scope.

Figure 9A:
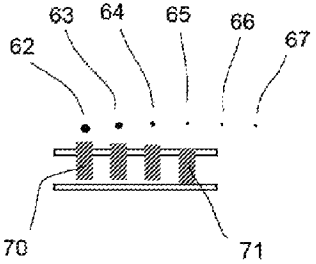
FIG. 9*a* is a front schematic view of an exemplary partial electromagnetic coil as may be employed within a pickup assembly of an output enhancing apparatus, in accordance with at least one embodiment.
Figure 9B:
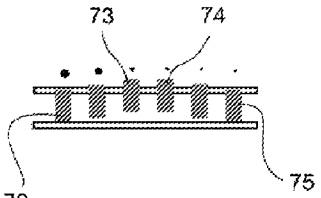
FIG. 9*b* is a front schematic view of an exemplary full electromagnetic coil as may be employed within a pickup assembly of an output enhancing apparatus, in accordance with at least one embodiment.

Turning briefly to FIGS. 9-11, there are shown side schematic views of various further exemplary full or partial coils having fixed or selectively adjustable tapered poles, which illustrations it will again be appreciated are non-limiting and simply convey aspects of the present invention in one or more exemplary embodiments, including even what constitutes a "full" or "partial" coil as relating to the number of strings, such that any tapering may be of "sets" or "subsets." By way of further example, while individual pole pieces are shown as being associated with each respective string, other configurations of ferromagnetic or other material in the exemplary electromagnetic coil context are possible. FIG. 9*a* shows a cross section or front schematic illustration of the ferromagnetic poles of a four-pole pickup such as the assembly of FIG. 4, with the poles in a descending array from the highest pole 70 to the lowest pole 71 beneath four strings 62, 63, 64 and 65 of a musical instrument such as a guitar, with the last two strings 66 and 67 of the exemplary six-string guitar not having an associated pole at least of the illustrated partial coil, there potentially being a second overlapping partial coil and/or a full coil also employed in connection with the illustrated partial coil to form a complete pickup assembly and output enhancing apparatus according to aspects of the present invention. FIG. 9*b* shows a cross section or front schematic illustration of the ferromagnetic poles of an alternative pickup in two descending arrays tapering from the middle outward where high pole 73 slopes progressively downward to low pole 72, and high pole 74 slopes in the opposite direction progressively downward to low pole 75. It will be appreciated that the arrangement of FIG. 9*b* may be accomplished using one full six-pole coil or two partial three-pole coils, for example.

Figure 10A:
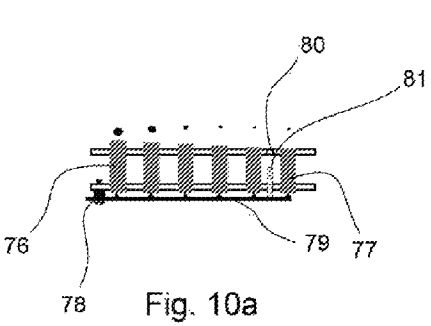
FIG. 10*a* is a front schematic view of a still further exemplary full electromagnetic coil as may be employed within a pickup assembly of an output enhancing apparatus, here in a first operational mode, in accordance with at least one embodiment.
Figure 10B:
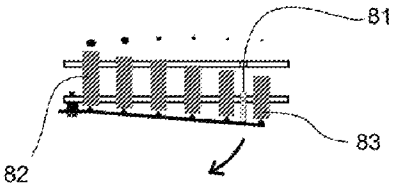
FIG. 10*b* is a front schematic view thereof in a second operational mode, in accordance with at least one embodiment.
Figure 11A:
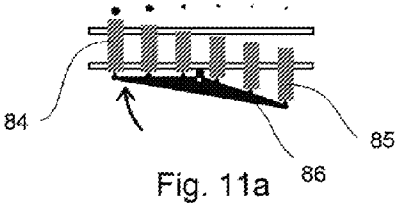
FIG. 11*a* is a front schematic view of a still further exemplary full electromagnetic coil as may be employed within a pickup assembly of an output enhancing apparatus, here in a first operational mode, in accordance with at least one embodiment.
Figure 11B:
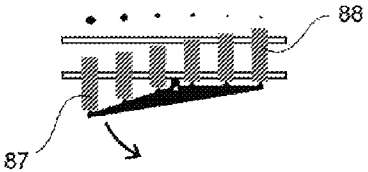
FIG. 11*b* is a front schematic view thereof in a second operational mode, in accordance with at least one embodiment.

FIGS. 10*a* and 10*b* schematically depict an alternative pickup assembly having a six-pole coil that is selectively shiftable between first and second operational modes. FIG. 10*a* shows a cross section or front schematic illustration of the ferromagnetic poles of a six-pole pickup in a descending array having a riser bar 79 attached at one end by screw 78 so as to define a pivot or flex point and supporting the bottoms of poles 76 thru 77, where adjustment of set screw 81, as accessed through access hole 80, is shown to allow the riser bar to be in a relatively high position where the poles descend progressively from high pole 76 to low pole 77 at a relatively minimal slope. Then, FIG. 10*b* shows the same components as are shown in FIG. 10*a*, except the set screw 81 has been alternately adjusted downward to flex the riser bar 79 downward to reposition the pole pieces from high pole 82 progressively downward to low pole 83, but at a relatively steeper downward slope than that shown in FIG. 10*a*. Similarly, FIG. 11*a* shows a cross section or front schematic illustration of the ferromagnetic poles of a further exemplary six-pole pickup in a descending array having a rocker bar 86 pivotally attached by a hinge near the center of the pole array and supporting the bottoms of the poles. In a first operational mode as depicted in FIG. 11*a*, the rocker bar 86 is positioned so as to place the pole 84 beneath the heavy low-gauge string (corresponding to string 62 in FIG. 9*a*) in a relatively high position wherein the poles then descend progressively from the high pole 84 to a low pole 85. Then, as illustrated in FIG. 11*b*, the same components are as shown in FIG. 11*a*, except the rocker bar 86 has been alternately rotated or pivoted to reposition the pole pieces from a high pole 88 beneath the thin high-gauge string (corresponding to string 67 in FIG. 9*a*), to descend progressively downward to the low pole 87. Those skilled in the art will appreciate that a variety of such mechanical, electromechanical, or other such manual, semi-automatic, or automatic mechanisms now known or later developed for selectively adjusting the relative positions and overall taper of two or more poles within a full or partial electromagnetic coil assembly are possible according to aspects of the present invention without departing from its spirit and scope.

Figure 12A:
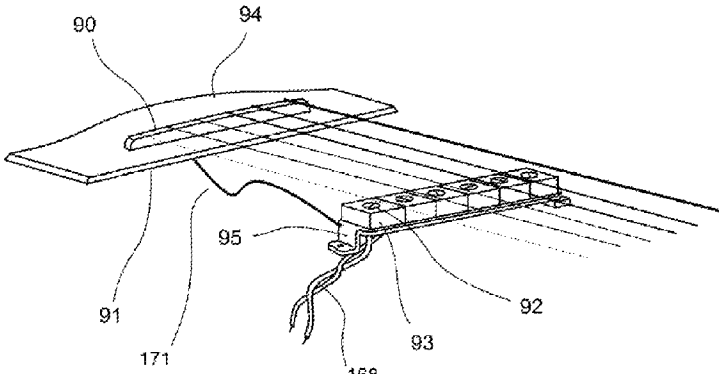
FIG. 12*a* is a partial perspective view of a further exemplary output enhancing apparatus defining a pickup assembly as installed, including a bank of trim potentiometers, in accordance with at least one embodiment.
Figure 12B:
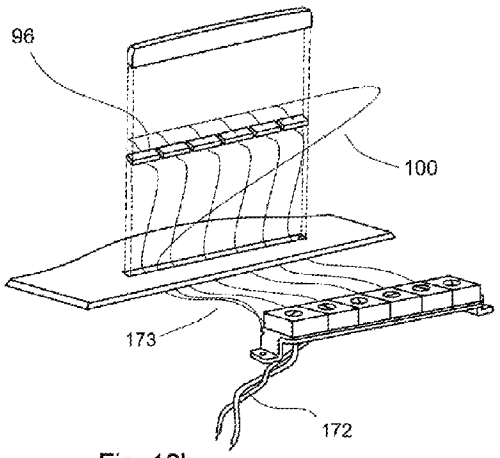
FIG. 12*b* is a partial exploded perspective view thereof, including a bank of piezo crystal elements, in accordance with at least one embodiment.

Referring next to FIGS. 12*a* and 12*b*, there are shown partial perspective views of a further exemplary output enhancing apparatus defining a pickup assembly according to aspects of the present invention, here as installed and including an array of piezo crystal elements defining the "poles" and an associated bank of trim potentiometers for volume adjustment per string. First, FIG. 12*a* shows an assembly representing a saddle 90 over six piezo crystal elements 96 (FIG. 12*b*), connecting by cable 171 to respective trim potentiometers 93 each having a trim screw 92, in an array of one per string, residing on assembly plate 95. The piezo crystal elements are beneath the saddle 90, in the bridge 94, with the electrical cable 171 protruding through a hole 91 in the underside of the bridge 94 and connecting to the array of trim potentiometers 93, and combining as a single output in electrical leads 168. FIG. 12*b* is an exploded partial perspective view of an assembly similar to that of FIG. 12*a*, showing an array of six individual piezo crystal elements 96 with negative electrical wire 100 attached to the piezo crystals 96 and six positive wires emanating from the underside of the bridge 94 (FIG. 12*a*) as wire ribbon 173 which includes wire 100 and six negative return wires from the crystals 96, each attaching to a potentiometer similar to potentiometer 93 in FIG. 12*a* and combining as a single output in electrical leads 172.

Figure 13:
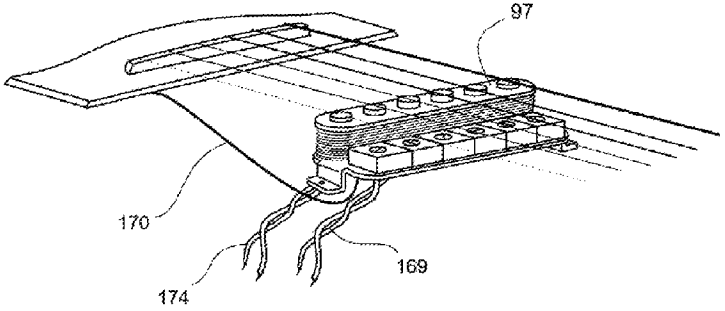
FIG. 13 is a partial perspective view of a still further exemplary output enhancing apparatus defining a pickup assembly as installed, including a full electromagnetic coil and a bank of trim potentiometers, in accordance with at least one embodiment.

Turning briefly to FIG. 13, there is shown a partial perspective view of a still further exemplary output enhancing apparatus defining a pickup assembly according to aspects of the present invention, here as a pickup having segmented piezo crystal elements 96 (FIG. 12*b*), each having a trim potentiometer 93 (FIG. 12*a*) for volume adjustment, combined with a conventional electromagnetic pickup coil 97. Thus, FIG. 13 shows a similar device to that of FIG. 12*a* having an electrical cable 170 returning signal from piezo crystal elements 96 (FIG. 12*b*) beneath the saddle 90 (FIG. 12*a*) to trim potentiometers 93 (FIG. 12*a*) combined as an output at electrical leads 169. Again, a conventional electromagnetic pickup coil 97 is added having output on electrical leads 174. Those skilled in the art will appreciate that any such combination of piezo crystals and related trim potentiometers, whether representing a full or partial coil, with any other electromagnetic coil, whether also full or partial or tapered or non-tapered, so as to form a pickup assembly and thus an output enhancing apparatus is possible according to aspects of the present invention without departing from its spirit and scope.

Figure 14B:
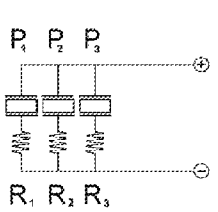
FIG. 14*b* is an electrical schematic illustrating a still further exemplary output enhancing apparatus, in accordance with at least one embodiment.
Figure 14A:
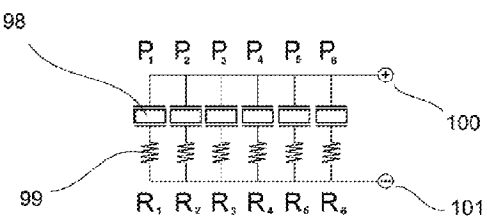
FIG. 14*a* is an electrical schematic illustrating an exemplary output enhancing apparatus as shown in FIGS. 12 and 13, in accordance with at least one embodiment.

FIGS. 14*a* and 14*b* are electrical schematics illustrating exemplary output enhancing apparatuses according to aspects of the present invention such as shown in FIGS. 12 and 13; namely, representing piezo crystal elements coupled with resistors, whether in quantities of six or three. First, FIG. 14*a* shows a schematic diagram of six piezo crystal elements 98 attached to six resistors 99 in an array. Resistors 99 are chosen or adjusted to have various ohm values at resistor R1 through R6 to model the taper of perceived output similar but not limited to the type of outputs as produced by various of the non-conventional coils shown and described herein. FIG. 14*b* shows a schematic diagram similar to FIG. 14*a*, but which is smaller in that it has three piezo crystal elements attached to three various resistors in an array rather than six. Again, any number and arrangement of such crystals or poles in or representative of a pickup coil may be employed according to aspects of the present invention.

It will be appreciated that the exemplary embodiments represented by FIGS. 12*a* through 14*b* demonstrate how piezo crystals could be utilized in arrays, where each crystal is coupled with a trim potentiometer by which the degree of taper from crystal to crystal could be adjusted to achieve similar results to those shown in the graphs of FIGS. 21*a* through 24*c* as generally representing the results achieved by combining electromagnetic coils in the manner indicated, as well as many other useful taperings of amplitude. It is to be understood that any reference to "electromagnetic coils" comprises such electromagnetic coils and any other such functional equivalents, including but not limited to piezo crystals or arrays, whether or not potentiometer adjusted, on which basis, again, such piezo crystals also define or enable "tapered poles" according to aspects of the present invention.

Turning next to FIGS. 15-19, there are shown perspective views of yet further alternative exemplary pickup assemblies according to aspects of the present invention, each here including one or more single or individual coils and/or one or more full electromagnetic coils, without or without a trim potentiometer, trim filter, or other such adjustment device. First, FIG. 15*a* shows a pickup assembly comprised of an assembly plate 115 supporting an array of six individual one-string electromagnetic coils 110 through 111, each having a ferromagnetic pole piece, the pole pieces arranged in a progressively descending array from high pole 112 to low pole 113, including hole 114 where coil 111 has no pole piece. Thus, FIG. 15*a* depicts a five-pole coil assembly, and it will appreciated by those skilled in the art that while such is here configured as being comprised of five individual or single coils with pole pieces, such a five-pole partial coil assembly could also be comprised of a unitary coil such as shown in FIG. 1*a* (three-pole partial coil 22) and in FIG. 2 (four-pole partial coil 33) and simply configured with a fifth pole, adjusting the geometry of the assembly plate and/or any associated full coil as needed. FIG. 15*b* shows a similar device to that shown in FIG. 15*a* having one-string electromagnetic coils 116 thru 117, here with a conventional electromagnetic pickup coil 118 attached.

Figure 16A:
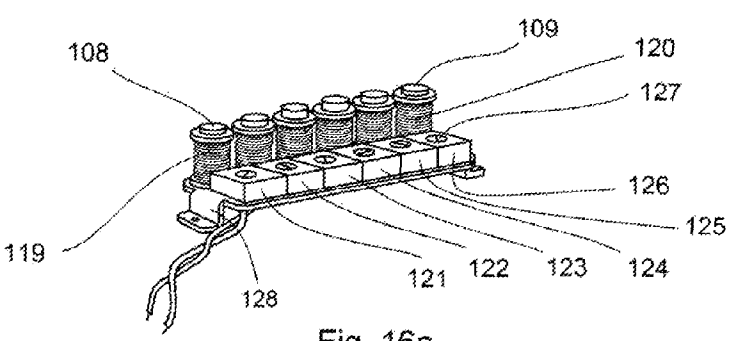
FIG. 16*a* is a perspective view of alternative exemplary six individual electromagnetic coils and a bank of trim potentiometers as may be employed within a pickup assembly of an output enhancing apparatus, in accordance with at least one embodiment.
Figure 16B:
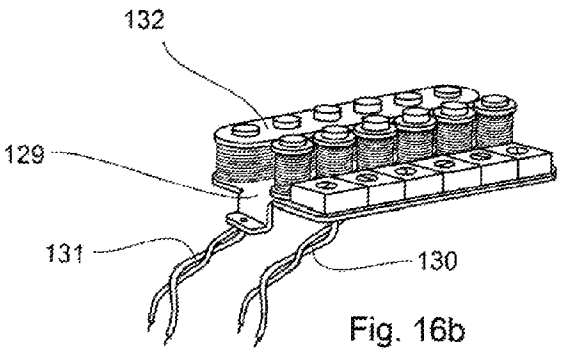
FIG. 16*b* is a perspective view of alternative exemplary six individual electromagnetic coils, a bank of trim potentiometers, and a full electromagnetic coil as may be employed within a pickup assembly of an output enhancing apparatus, in accordance with at least one embodiment.
Figure 15A:
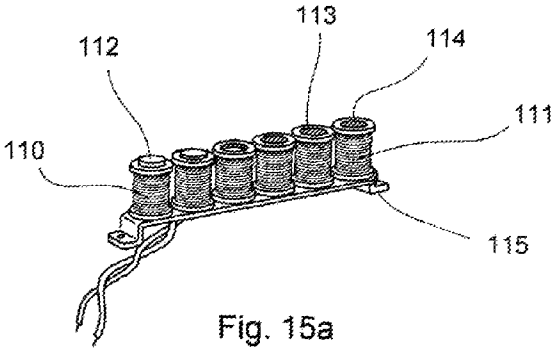
FIG. 15*a* is a perspective view of alternative exemplary six individual electromagnetic coils as may be employed within a pickup assembly of an output enhancing apparatus, in accordance with at least one embodiment.
Figure 15B:
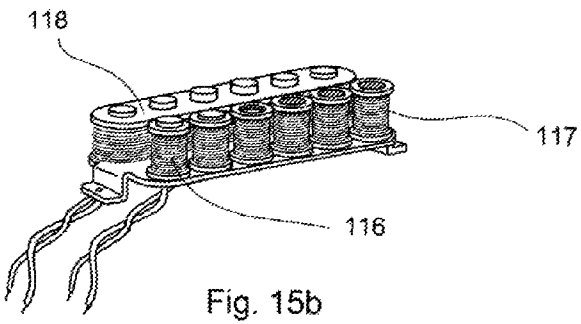
FIG. 15*b* is a perspective view of alternative exemplary six individual electromagnetic coils and a full electromagnetic coil as may be employed within a pickup assembly of an output enhancing apparatus, in accordance with at least one embodiment.

FIG. 16*a* shows a further exemplary pickup assembly comprised of an assembly plate 128 supporting an array of six individual one-string electromagnetic coils 119 through 120, each having a ferromagnetic pole piece, the pole pieces arranged in a conventional array from pole 108 to pole 109, with the poles being relatively higher in a tapered fashion therebetween so as to yield substantially equal volume or amplitude from the six strings, or balance among the six strings in a manner known in the art. An array of trim potentiometers 121, 122, 123, 124, 125 and 126 are arranged so that each individual coil has an associated trim potentiometer for string amplitude. Each potentiometer has trim adjustment means like trim screw 127. All or select ones of the poles may have a potentiometer. FIG. 16*b* shows a similar device to that shown in FIG. 16*a* having electrical output leads 130, which device is also similar to that of FIG. 15*b*, only in FIG. 16*b* showing the array of potentiometers added to the pickup assembly comprising the individual coils defining effectively the partial coil employed in conjunction with a full coil. The base plate 129 may be enlarged to support the addition of the conventional electromagnetic coil assembly 132 having electrical output leads 131 or the addition of the potentiometer array, as the case may be. Once again, it will be appreciated that a wide variety of such arrangements is possible according to aspects of the present invention.

FIGS. 15*a* through 16*b* thus generally show how individual electromagnetic coils per string could be used to achieve useful taperings of amplitude, either by positioning of the pole pieces or by the use of trim potentiometers to taper the amplitude of the individual coils, according to aspects of the present invention.

Figure 18:
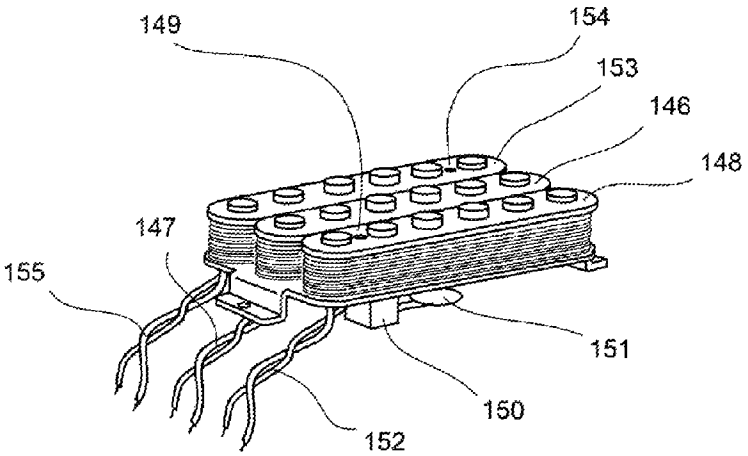
FIG. 18 is a perspective view of an alternative exemplary three full electromagnetic coils and trim potentiometers connected to two of the full electromagnetic coils as may be employed within a pickup assembly of an output enhancing apparatus, in accordance with at least one embodiment.
Figure 19:
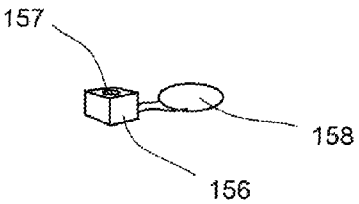
FIG. 19 is a perspective view of an exemplary trim potentiometer thereof, in accordance with at least one embodiment.
Figure 17:
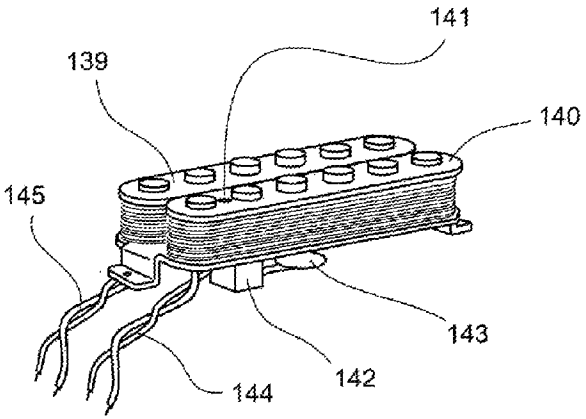
FIG. 17 is a perspective view of an alternative exemplary two full electromagnetic coils and a trim potentiometer connected to one of the full electromagnetic coils as may be employed within a pickup assembly of an output enhancing apparatus, in accordance with at least one embodiment.

FIGS. 17 and 18 depict still further alternative exemplary embodiments of pickup assemblies according to aspects of the present invention, here comprising at least one full coil having a trim filter for tapering off bass or treble frequencies depending on its configuration and installation. FIG. 17 shows a pickup assembly which has a conventional electromagnetic pickup coil 139 having electrical leads 145 combined with another similar full coil 140 having additionally a trim filter or potentiometer 142 wired to a capacitor 143, which attaches to electrical leads 144. The trim potentiometer 142 has a trim screw (not seen) but which is accessible through a hole 141 in the coil 140 for adjustment of the quantity or amount of filtered frequencies to be separated out, with the capacitor 143 establishing which frequencies are filtered or separated. FIG. 18 shows a similar pickup assembly which has a conventional electromagnetic pickup coil 146 having electrical leads 147, combined with another similar coil 148 which has additionally a trim potentiometer 150 wired to a capacitor 151, which attaches to electrical leads 152. The trim potentiometer again has a trim screw (not seen) but which is accessible through a hole 149 in the coil 148. Further, there is attached a third coil 153, which is identical to coil 148 and does also have attached a trim potentiometer (not seen) and a capacitor (not seen) and electrical leads 155, and has an access hole 154 for trim potentiometer setscrew (not seen) adjustment. FIG. 19 shows an exemplary trim potentiometer 156 having set screw 157, with attached capacitor 158, as may be employed in the alternative pickup assemblies of FIGS. 17 and 18. Once more, any such arrangements of coils and potentiometers beyond those shown and described are possible according to aspects of the present invention without departing from its spirt and scope.

It will be appreciated by those skilled in the art that the embodiments of FIGS. 17 and 18 show how frequency filters could be used to create tapered sets or subsets by vibration frequency instead of amplitude. Coils which output filtered sets or subsets of frequencies could be made to function similarly to the coils in FIG. 1*a* without departing from the spirit and scope of the invention, because a frequency-filtered coil, by careful choice of capacitor, could be made to filter particular frequencies and with a particular slope to approximate the slopes across strings such as shown, for example in FIGS. 22*b* and 24*b*. Creating tapered sets through frequency filtering of pickup outputs could provide a high degree of frequency separation between pickup outputs. And frequency filtering could be made to have a discerning effect from high to low or from low to high frequency, approximately similar to the way in which arrays of diminishing amplitudes of strings can be made to have a discerning effect from high to low or from low to high pitch of strings. Creating tapered sets or subsets by these alternate methods of either frequency filtering or by selectively setting individual string amplitudes may have usefulness similar to the preferred exemplary embodiments shown and described in connection with FIGS. 1 through 8 in the context of full and partial electromagnetic coils with selectively positioned poles.

Figure 20:
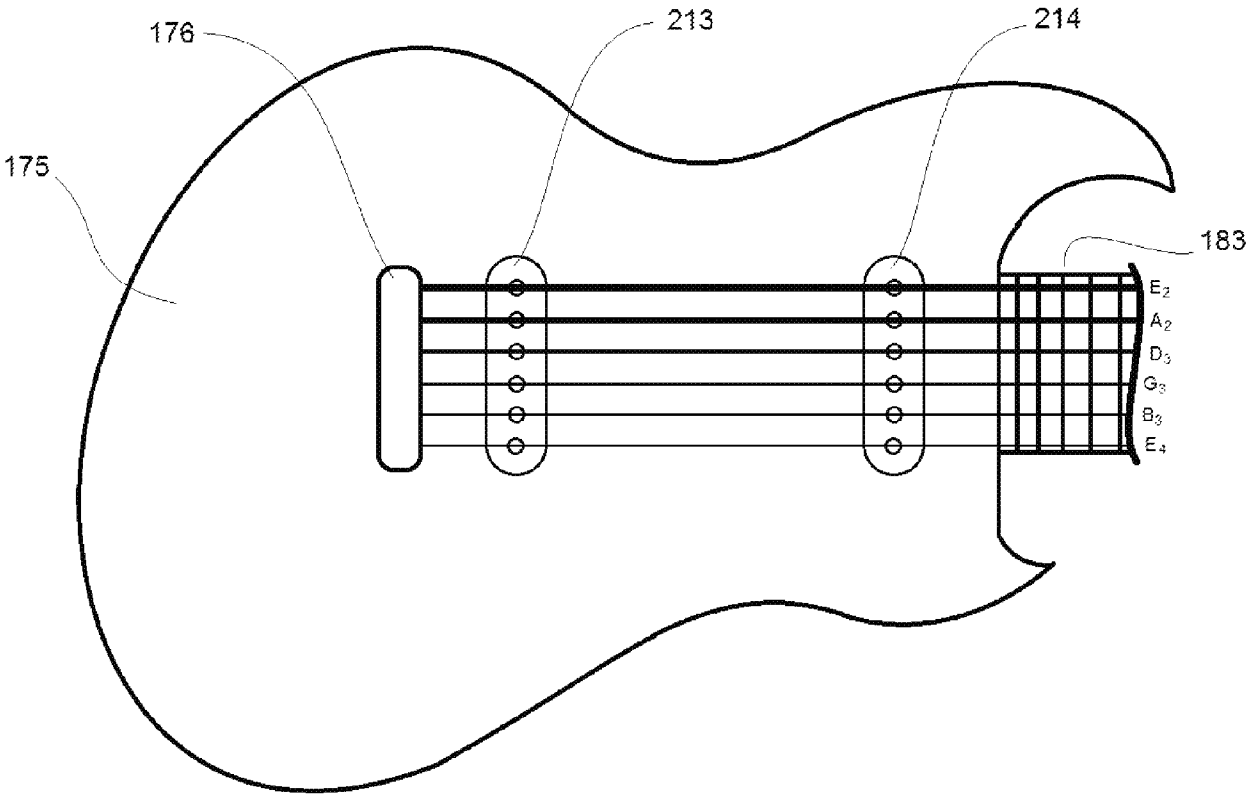
Fig. 20 PRIOR ART
FIG. 20 (Prior Art) is a schematic illustration of a stringed instrument having two offset conventional pickups.

In terms of the installation of any such pickup assemblies as shown and described herein on or in operable connection with a stringed musical instrument such as a guitar, there is shown in FIG. 20 a schematic illustration of a prior art or conventional six-stringed electric guitar having two offset conventional pickups, one pickup 213 closer to the bridge 176 and one pickup 214 closer to the neck 183, the pickups 213, 214 being mounted on the guitar body 175 as shown and described beneath the strings. That is, FIG. 20 shows a portion of a six-stringed musical instrument such as a guitar with conventional tuning of the E2, A2, D3, G3, B3 and E4 strings, and having a body 175 with a fretted neck 183 (shown truncated) and a bridge 176 for anchoring the strings. All string call-outs herein are to be understood as merely exemplary as being associated with a particular stringed instrument and thus non-limiting. Conventional pickup 214 is located near the neck to benefit from the fundamental-rich sound produced by the strings near to their midsection over the neck. Conversely, conventional pickup 213 is located near to the bridge 176 to benefit from the harmonically-rich sound naturally produced by the strings close to their endpoints at the bridge 176 where less of the fundamental frequency of the strings is encountered, leaving a higher concentration of harmonic overtones. Before proceeding to other such schematic representations of exemplary ones of the non-conventional, new and novel pickup assemblies according to aspects of the present invention as installed on or in operable connection with a stringed instrument such as a guitar, attention is first turned to various graphical representations of the use of multiple coils, such as a full coil and a partial coil, together to create blended or tapered enhanced output from the instrument.

Turning, then, to FIGS. 21-24, there are shown graphical illustrations of exemplary full and non-tapered or tapered partial electromagnetic coils individually and then combined as may be employed within an output enhancing apparatus according to aspects of the present invention. It is to be understood that any reference to "electromagnetic coils" comprises such electromagnetic coils and any other such functional equivalents, including composite or unitary coils with multiple pole pieces and individual single coils whereby pole height sets the taper, potentiometer adjusted coils employed in setting the taper, or any other such means now known or later developed whereby an effective full coil and an effective partial coil without taper or with fixed or selectively adjusted taper are employed in tandem, again whether installed in tandem or not, as will be further appreciated from the below discussion in connection with FIGS. 25-29. For the graphs of FIGS. 21-24, a triangle marker indicates sound rich in harmonic content, a circle marker indicates sound rich in fundamental content, and a square marker indicates a blend of harmonic content and fundamental content.

Figure 21A:
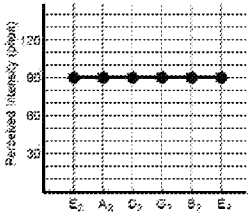
FIGS. 21*a*-21*c* are graphical illustrations of exemplary full and non-tapered partial electromagnetic coils individually and then combined as may be employed within an output enhancing apparatus, in accordance with at least one embodiment.
Figure 21B:
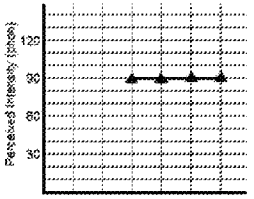
Figure 21C:
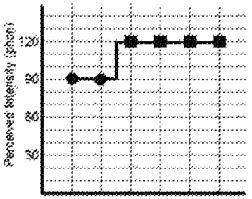

FIG. 21*a* shows a graph illustrating the output of a six-pole full coil mounted near the neck of a guitar where the strings are rich in fundamentals (plotted with circle markers), and where the ferromagnetic poles have been arranged to achieve equal intensity of 90 phon per string. FIG. 21*b* shows a graph illustrating the output of a four-pole partial coil mounted near the bridge of a guitar where the strings are rich in harmonics (plotted with triangle markers), and where the ferromagnetic poles have been arranged to achieve equal intensity of 90 phon per string, here associated with high strings D3 through E4. FIG. 21*c* then shows a graph illustrating the combined outputs of the full and partial coils represented by FIGS. 21*a* and 21*b*, where low strings E2 and A2 are rich in fundamental content (plotted in circle markers), and high strings D3 through E4 are a blend of harmonic-rich content and fundamental-rich content (plotted in square markers). Because the intensity of the strings of the partial coil as depicted in FIG. 21*b* are not tapered, but are equal, the line of the graph reveals a "step" in the intensity of phon at string D3. The markers further reveal a transition from fundamental richness in the low strings (E2 and A2) to a blend of fundamental and harmonic content in the boosted high strings (D3, G3, B3 and E4). It will be appreciated that with these and all graphs the representative phons, such as 90 phons, or any relative measure of phons as when a full and a partial coil are combined on certain strings, are merely illustrative and non-limiting. The actual measure of the phons and the degree of a step up or step down in phons is relative and may vary based on a number of factors, such that, again, the values depicted in the graphs are to be understood as merely illustrative of features, concepts and aspects of the present invention. The steps or slopes in the graphs may indeed be exaggerated for simplicity and ease of illustration and viewing.

Figure 22A:
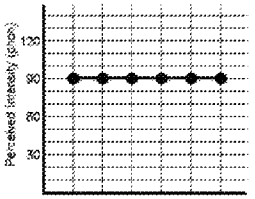
FIGS. 22*a*-22*c* are graphical illustrations of exemplary full and tapered partial electromagnetic coils individually and then combined as may be employed within an output enhancing apparatus, in accordance with at least one embodiment.
Figure 22B:
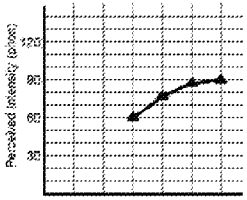
Figure 22C:
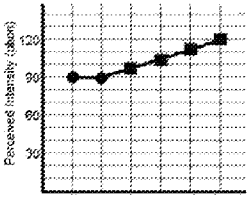

FIG. 22*a* shows a graph illustrating the output of a six-pole full coil mounted near the neck of a guitar where the strings are rich in fundamentals (plotted with circle markers), and where the ferromagnetic poles have been arranged to achieve equal intensity of 90 phon per string, similar to FIG. 21*a*. FIG. 22*b* shows a graph illustrating the output of a four-pole tapered coil mounted near the bridge of a guitar where the strings are rich in harmonics (plotted with triangle markers), and where the ferromagnetic poles have been arranged in a descending array from an intensity of 90 phon at string E4 to 60 phon at string D3. FIG. 22*c* then shows a graph illustrating the combined outputs of the full and partial coils represented by FIGS. 22*a* 22*b*, where low strings E2 and A2 are rich in fundamental content (plotted in circle markers), and high strings D3 through E4 are a blend of harmonic-rich content and fundamental-rich content (plotted in square markers). Because the intensity of the strings of the partial coil as depicted in FIG. 22*b* are arranged in a descending array with string D3 having the least intensity, the line of the graph reveals a smoothly graduated transition of increased intensity from string A2 through string E4, more about which is said below. The markers reveal a transition from fundamental richness in the low strings (E2 and A2) to a blend of fundamental and harmonic richness in the boosted high strings (D3, G3, B3 and E4). Again, all such transitions and the degree or extent thereof are merely illustrative of aspects of the present invention.

Figure 23A:
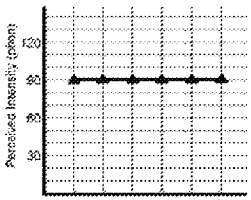
FIGS. 23*a*-23*c* are graphical illustrations of further exemplary full and non-tapered partial electromagnetic coils individually and then combined as may be employed within an output enhancing apparatus, in accordance with at least one embodiment.
Figure 23B:
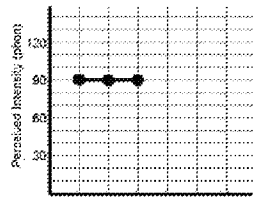
Figure 23C:
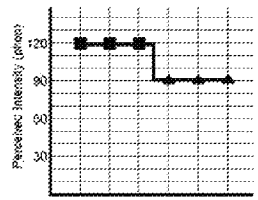

FIG. 23*a* shows a graph illustrating the output of a six-pole full coil mounted near the bridge of a guitar where the strings are rich in harmonics (plotted with triangle markers), and where the ferromagnetic poles have been arranged to achieve equal intensity of 90 phon per string. FIG. 23*b* shows a graph illustrating the output of a three-pole partial coil mounted near the neck of a guitar where the strings are rich in fundamentals (plotted with circle markers), and where the ferromagnetic poles have been arranged to achieve equal intensity of 90 phon per string, here associated with low strings E2, A2 and D3 rather than the partial coil associated with high strings D3 through E4 as in the graphs of FIGS. 21 and 22. FIG. 23*c* shows a graph illustrating the combined outputs of the full and partial coils represented by FIGS. 23*a* and 23*b*, where high strings E4 through G3 are rich in harmonic content (plotted in triangle markers), and low strings E2 through D3 are a blend of harmonic-rich content and fundamental-rich content (plotted in square markers). Because the intensity of the strings of the partial coil as depicted in FIG. 23*b* are not tapered, but are equal, the line of the graph again reveals a "step" in the intensity of combined phon at string D3. The markers further reveal a transition from harmonic richness in the high strings (G3, B3 and E4) to a blend of fundamental and harmonic content in the boosted low strings (E2, A2 and D3).

Figure 24A:
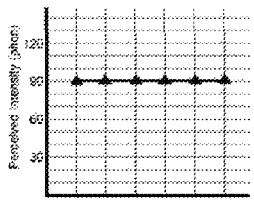
FIGS. 24*a*-24*c* are graphical illustrations of further exemplary full and tapered partial electromagnetic coils individually and then combined as may be employed within an output enhancing apparatus, in accordance with at least one embodiment.
Figure 24B:
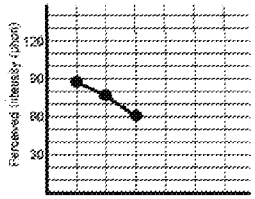
Figure 24C:
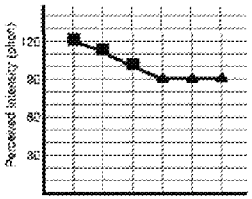

Finally, FIG. 24*a* shows a graph illustrating the output of a six-pole full coil mounted near the bridge of a guitar where the strings are rich in harmonics (plotted with triangle markers), and where the ferromagnetic poles have been arranged to achieve equal intensity of 90 phon per string. FIG. 24*b* shows a graph illustrating the output of a three-pole partial coil mounted near the neck of a guitar where the strings are rich in fundamentals (plotted with circle markers), and where the ferromagnetic poles have been arranged in a descending array from an intensity of 90 phon at string E2 to 60 phon at string D3. FIG. 24*c* shows a graph illustrating the combined outputs of the full and partial coils represented by FIGS. 24*a* and 24*b*, where high strings E4 through G3 are rich in harmonic content (plotted in triangle markers), and low strings D3 through E2 are a blend of harmonic-rich content and fundamental-rich content (plotted in square markers). Because the intensity of the strings of the partial coil as depicted in FIG. 24*b* are arranged in a descending array with string D3 having the least intensity, the line of the graph reveals a smoothly graduated transition of increased intensity from string G3 through string E2. The markers again further reveal a transition from harmonic richness in the high strings (G3, B3 and E4) to a blend of fundamental and harmonic richness in the boosted low strings (E2, A2 and D3).

Tapering of the string intensities within string groups is advantageous when boosting and transforming the overall signal with such groups, as it assures that the groups, as well as the overall composite signal, will convey a coherent representation of the instrument. The impact upon the listener of the sound source as depicted in FIG. 24*c* is superior to that of FIG. 23*c* precisely because the assembly of FIG. 24*c* incorporates a tapered component (partial coil) which produces a tapered whole, and as such the transition across all the instrument's strings when playing or strumming sounds smooth and coherent without the impression of aberrant, loud or mysteriously missing strings. In the assembly depicted in FIG. 23*c*, a less favorable impression is made by the loudness of string D3 as it psychoacoustically "suggests" that, because it is in fact a six-string instrument, strings G3 and B3 should be more audible. When they are not it sounds as though they are either missing, or that the sound of the group of low strings E2 through D3 might even be another sort of instrument. Such impressions constitute a less coherent overall experience and thus are less desirable or useful. However, it will be appreciated that in certain contexts such an effect may be desired, such that a combination of a full coil and a non-tapered partial coil in a single pickup or other such apparatus or arrangement may also be practiced according to aspects of the present invention. More generally, it will be appreciated by those skilled in the art that a virtually infinite variety of blends of full and partial pickups or coils and hence strings are possible, such that the exemplary such combinations as shown in the figures, including the graphical representations of FIGS. 21-24, are to be understood as illustrative and non-limiting. By way of further example, partial coils having any number of poles may be combined rather than with a full coil, multiple partial coils may be combined with a full coil, or one or more partial coils may be combined with one or more full coils, any of which having tapered or non-tapered pole pieces, in whole or in part, and to any relative degree to suit a particular application, instrument or musician. By way of still further example, FIGS. 21-24 moreover depict enhancements of timbre in terms of harmonic and fundamental content, producing various differences in timbre as caused by changes to electrical impedance perceived by the instrument amplifier, and accordingly, various combinations of full and partial coils may achieve unique enhancements in timbre owing to changes of electrical impedance. Accordingly, once more, it is to be understood that the present invention is not limited to any of the particular embodiments shown and described, which are merely exemplary of features and aspects of the invention.

Figure 25:
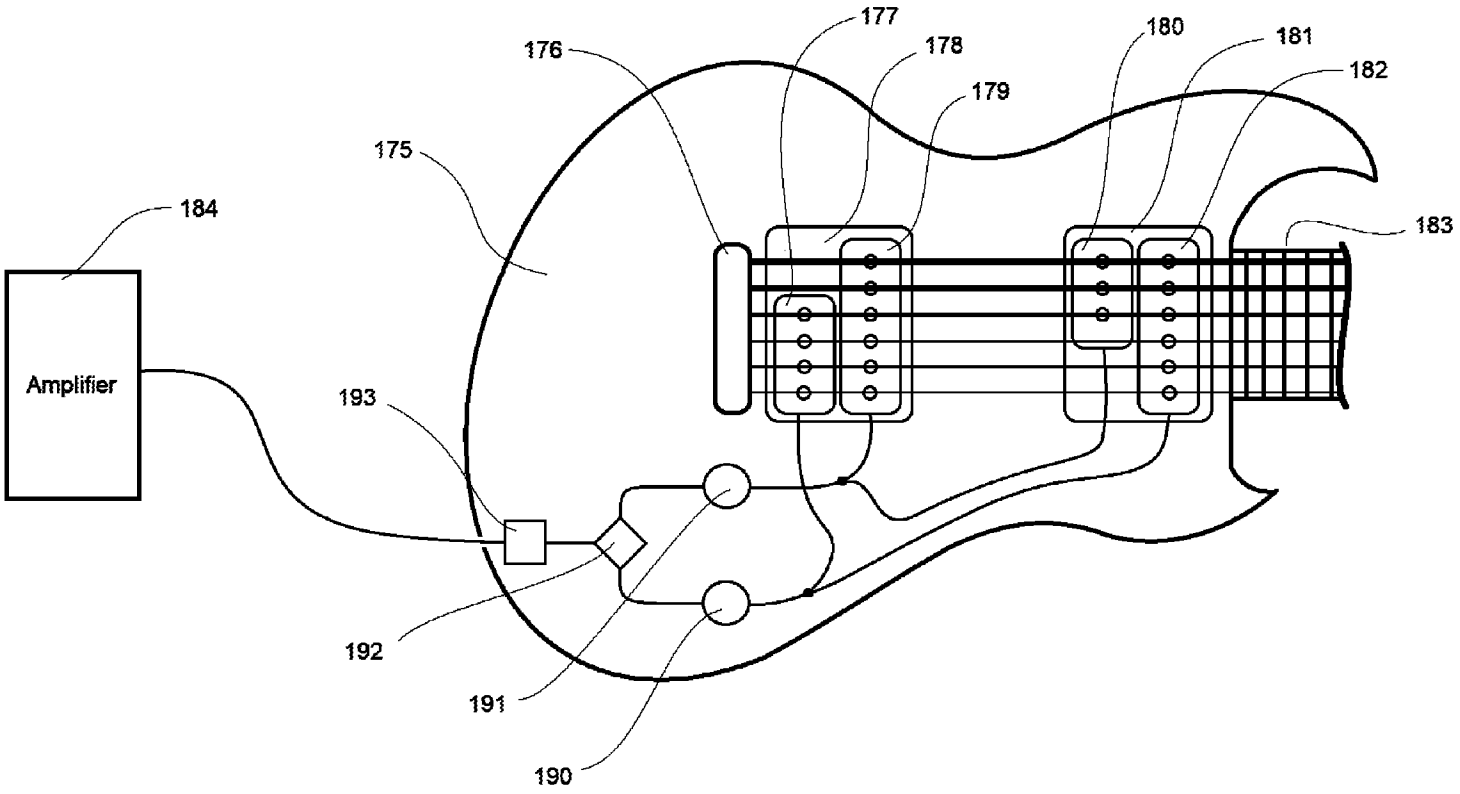
FIG. 25 is a schematic illustration of a stringed instrument having multiple pickup assemblies defining an exemplary output enhancing apparatus, in accordance with at least one embodiment.

Turning now to FIGS. 25-29, there are shown schematic illustrations of a stringed instrument such as an electric guitar having one or more pickup assemblies defining an exemplary output enhancing apparatus, each comprising at least one full coil and at least one partial coil, whether tapered or non-tapered, though again, in some embodiments there may be combined two or more partial coils with no full coil. FIG. 25 shows two pickup assemblies 178 and 181 on a six-stringed instrument such as a guitar with body 175 and neck 183 (shown truncated), where one pickup assembly 178 is nearer the bridge 176 where the instrument's strings are rich in upper harmonics, and the other pickup assembly 181 is nearer the neck 183 where the instrument's strings better represent the fundamental pitch of notes played. Each pickup assembly 178 and 181 has a conventional electromechanical pickup coil 179 and 182, respectively, which spans all strings, and an electromechanical pickup mini-coil or partial coil 177 and 180, respectively, where mini-coil 177 spans three strings and mini-coil 180 spans four strings. Particularly, as shown, the four-pole mini-coil or partial coil 177 is associated with the four highest strings (D3, G3, B3 and E4) and the three-pole mini-coil or partial coil 180 is associated with the three lowest strings (E2, A2 and D3). Again, it will be appreciated that such pickups or coils may be swapped or configured in a wide variety of ways beyond those shown and described, including but not limited to positioning the partial coil associated with the high strings closer to the neck and the partial coil associated with the lower strings closer to the bridge, effectively swapping and/or rotating/flipping the exemplary pickup assemblies. Any such partial coils can be on either side of any associated full coil, meaning that in any particular context either the partial coil or the full coil may be closer to the bridge or neck, respectively. As such, once more, the particular arrangement shown and described is to be understood as illustrative and non-limiting. In the exemplary embodiment, the first pickup assembly 178 is substantially similar to the assembly of FIG. 2 having a full coil 35 and the alternate four-pole partial coil subassembly 34, and the second pickup assembly 181 is substantially similar to the pickup assembly shown in FIG. 1*a* having a full coil 21 and a three-pole partial coil 22, noting again that such figures, and particularly FIGS. 25-29, are schematic representations and so are not to be taken literally or to scale in terms of the absolute or relative sizes or configurations of the various components and subassemblies and finished assemblies. In connecting the pickup assembly leads, the full coil 179 of the first pickup assembly 178 is connected directly to the partial coil 180 of the second pickup assembly 181, and the full coil 182 of the second pickup assembly 181 is connected directly to the partial coil 177 of the first pickup assembly 178. Thus, the shorter partial coils 177 and 180 could be said to be cross-wired with the full coils 182 and 179 of the opposite pickup assembly. Each pickup assembly 178 and 181 has a volume control; the first pickup assembly 178 has volume control 191 and the second pickup assembly 181 has volume control 190. Switch 192 is selective between the pickup combinations 178 and 181, and a mono signal is output on jack 193 to an amplifier 184. Alternatively, it would be common for sound effects processing to precede the amplifier.

Figure 26:
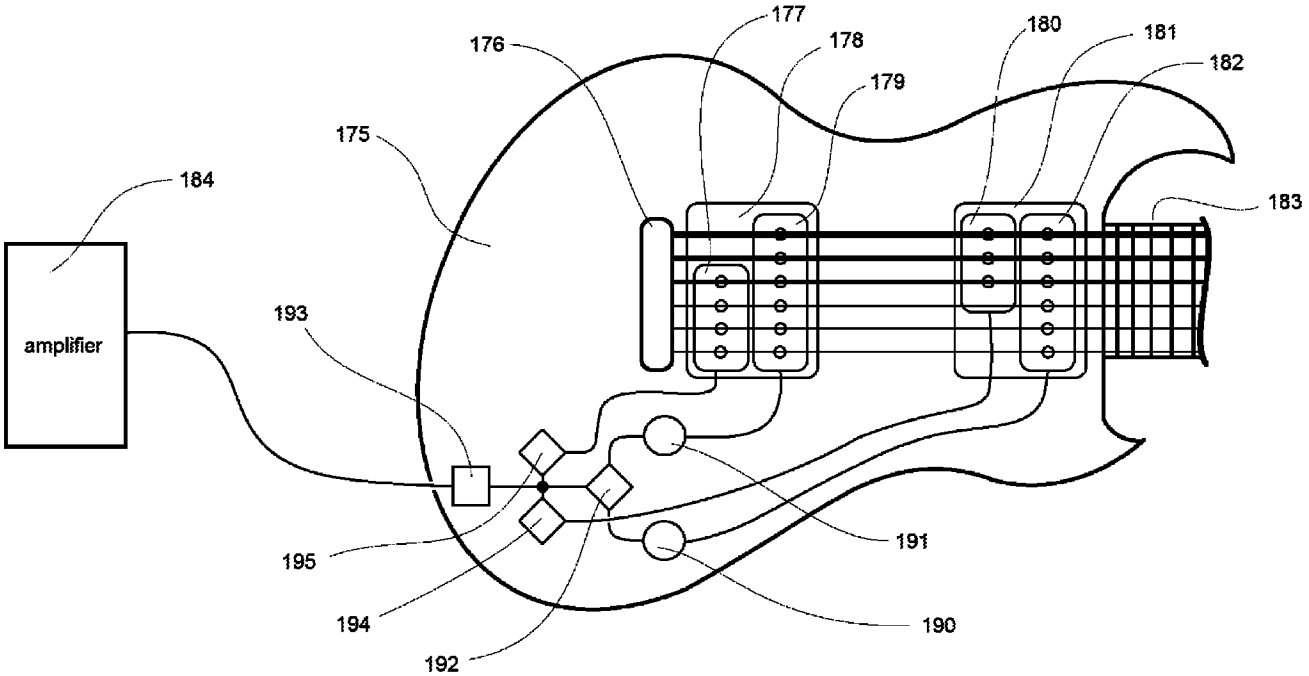
FIG. 26 is a schematic illustration of a stringed instrument having multiple pickup assemblies defining a further exemplary output enhancing apparatus, in accordance with at least one embodiment.

By way of further example, FIG. 26 is similar to FIG. 25 except that partial coils 177 and 180 are not wired specifically to either pickup assembly 178 or 181, but are instead each individually selectable, where switch 195 turns partial coil 177 on or off and switch 194 turns partial coil 180 on or off.

Figure 27:
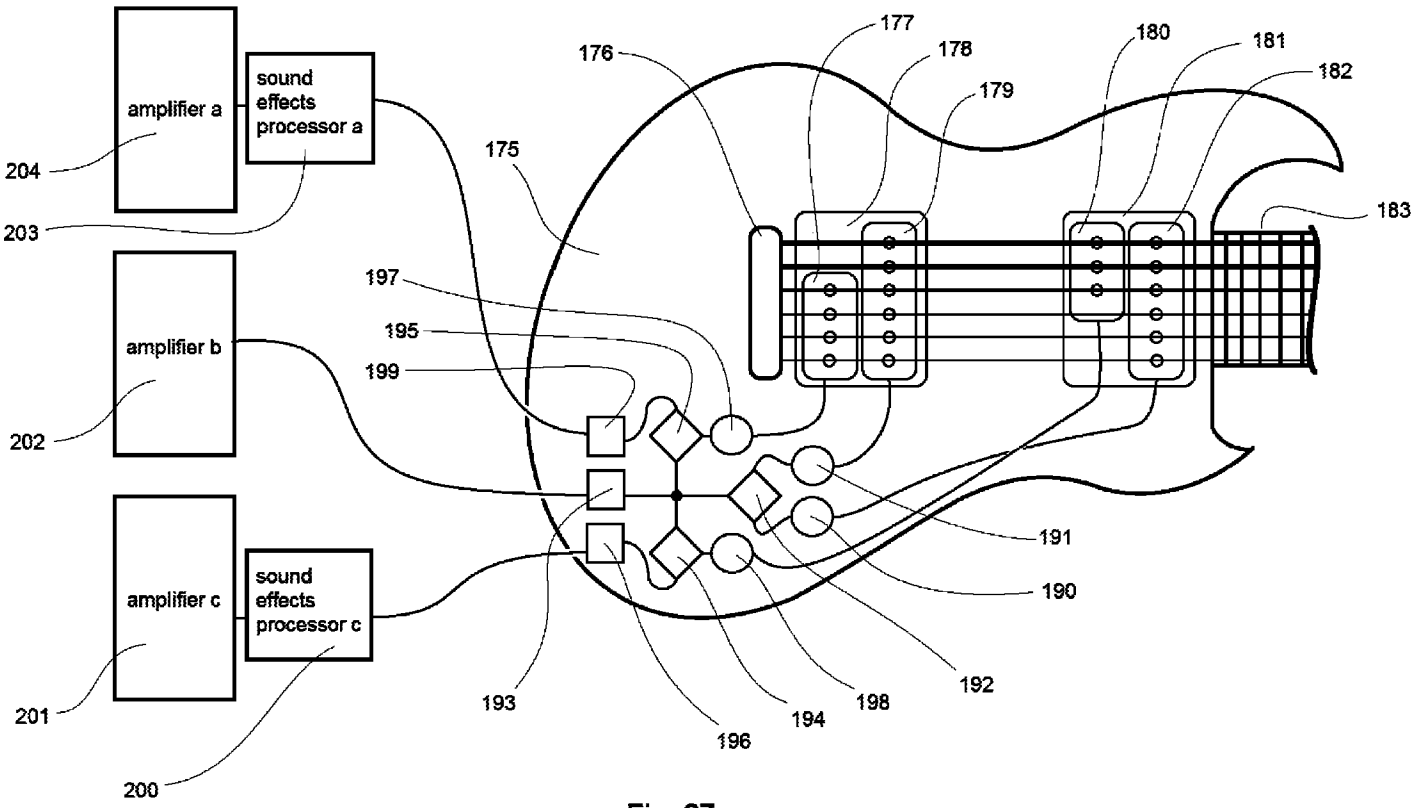
FIG. 27 is a schematic illustration of a stringed instrument having multiple pickup assemblies defining a still further exemplary output enhancing apparatus, in accordance with at least one embodiment.

FIG. 27 is similar to FIG. 26 except that switches 195 and 194, instead of turning on or off partial coils 177 and 180, respectively, selectively route them between combined output jack 193 or to their own output jacks 199 and 196, respectively, where switch 195 can route partial coil 177 out on jack 199 and switch 194 can route partial coil 180 out on jack 196. Jack 199 is connected to amplifier "a" denoted as 204, passing optionally through sound effects processor "a" denoted as 203. Similarly, jack 196 is connected to amplifier "c" denoted as 201, passing optionally through sound effects processor "c" denoted as 200. The common jack 193 is connected to amplifier "b" denoted as 202. For volume adjustment, partial coil 177 is wired through volume control 197 and partial coil 180 is wired through volume control 198. In connection with the alternative exemplary embodiment of FIG. 27, it should be noted that the output signals of the distinctive string groups provided by partial coils 177 and 180 might be routed by switches 194 and 195 to independent amplifiers "a" and "c", denoted as 204 and 201, respectively, whereby the perceived intensity of such partial coils 177 and 180 could be determined to a far greater degree than when these coils are routed to amplifier "b" denoted as 202 and mixed with full coils 179 and 182. It should also be noted that by so separating, independent sound effects processing might optionally be applied to the output of either or both of partial coils 177 and 180, to provide a greater degree of distinction to their sound. Mini-coils vaguely comparable to 177 and 180 have been used in the past, but were not structured or deployed for sound enhancement/emphasis in the form of string group or subset boost or transformation, but have instead been designed and employed to merely divide the overall stings into two disparate groups for the sake of normalizing intensity, more efficiently amplifying, or cancelling ambient hum interference signals through reversal of coil polarities. Prior to the present invention, mini-coils have not been used for boosting or transforming output signals.

Figure 28:
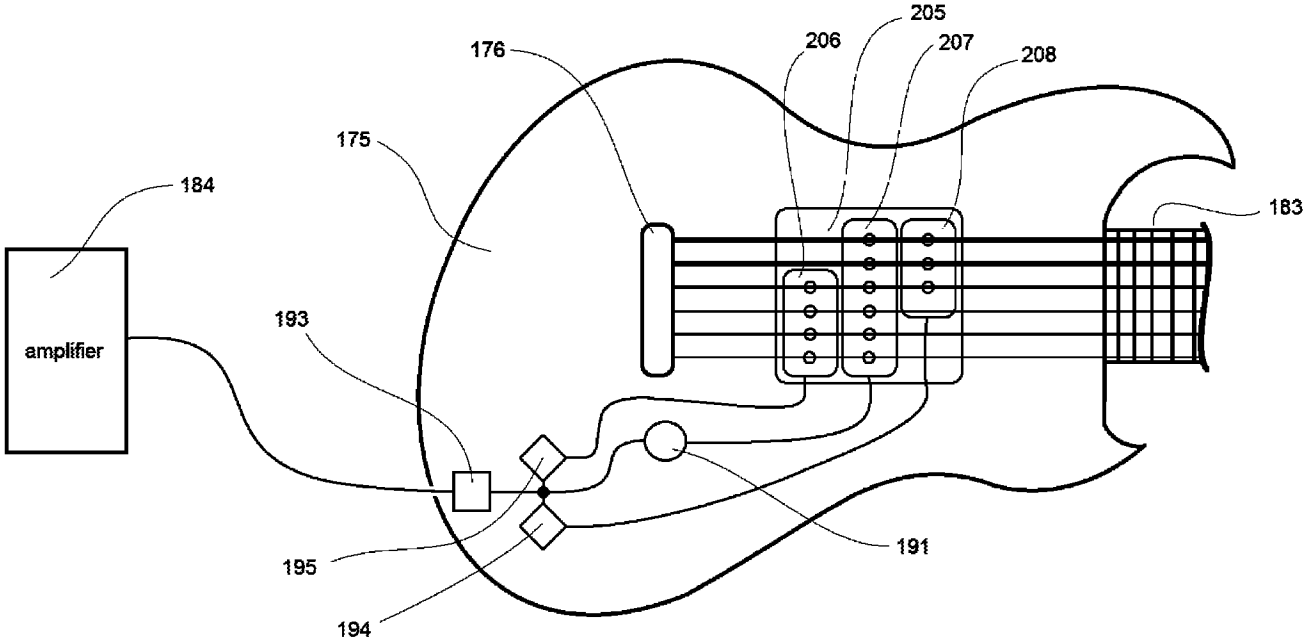
FIG. 28 is a schematic illustration of a stringed instrument having a single pickup assembly defining a still further exemplary output enhancing apparatus, in accordance with at least one embodiment.

FIG. 28 is similar to FIG. 26 except that instead of having two pickup assemblies with two coils each, there is instead one pickup assembly 205 with three coils such as the pickup assembly shown in FIG. 8. In the exemplary embodiment, the middle coil is a full coil 207 that spans all strings, one mini-coil or first partial coil 206 spans the four highest strings (D3, G3, B3 and E4), and the other mini-coil or second partial coil 208 spans the three lowest strings (E2, A2 and D3). The mini-coils 206 and 208 are controlled similarly to coils 177 and 180 of FIG. 26, with an associated switch 195 and 194 for selectively turning on or off partial coils 177 and 180, respectively, and routing either or both partial coil 177 and 180 to the mono jack 193, and further with the signal from the full coil 207 selectively sent to the jack 193 under the control of volume control 191.

Figure 29:
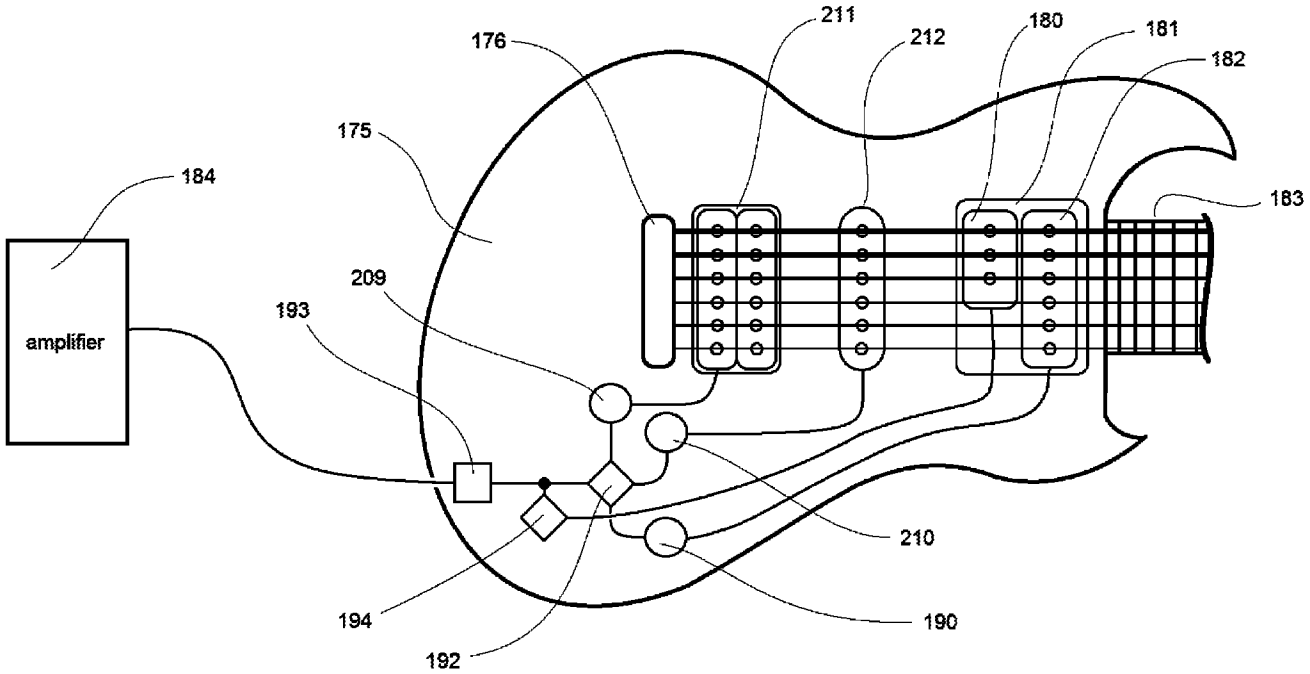
FIG. 29 is a schematic illustration of a stringed instrument having multiple pickup assemblies defining a still further exemplary output enhancing apparatus, in accordance with at least one embodiment.

Finally, FIG. 29 shows a pickup assembly 181 like that of FIG. 1*a* combined with two conventional pickup assemblies 211 and 212 having volume controls 209 and 210, respectively. Here, the pickup assembly 181 comprising a full coil 182 and a partial coil 180 is shown as being positioned closest to the neck 183 with the conventional pickup assemblies 211 and 212 between it and the bridge 176, though it will be appreciated that the inventive pickup assembly 181 may also be positioned between the conventional pickup assemblies 211 and 212 or closest to the bridge 176. Pickup assembly 211 and to some degree assembly 212 are each capable through the use of switches of being combined with the mini-coil or partial coil 180 to achieve the effects of this invention as shown and described in connection with, for example, the graphs of FIG. 23*c* (if the poles of partial coil 180 produce normalized intensity across strings) or FIG. 24*c* (if the poles of partial coil 180 are arranged in an appropriate descending array).

More generally, the output enhancing apparatus of this invention such as the pickup assembly of FIG. 1*a* when situated on a stringed musical instrument such as a guitar is operated by sending its electrical output signal, possibly combined with the electrical output signal from other pickup assemblies, to an amplifier or amplifiers. The apparatus can provide an enhancement/emphasis of the instrument's sound that is unique, useful, and desirable over that of a conventional guitar pickup, by providing a reduced partial signal of string output, or a subset of strings, that can be used by itself or in combination with other full string output signals to boost or transform the overall output. In its preferred embodiment such as FIG. 1*a*, part of the output signal is a produced by a mini-coil or partial coil 22 that is a tapered subset of the entire sound of the instrument. Because the perceived intensity of the three strings captured by the partial coil 22 is tapered, when combined with other coils it will produce a smoothly transitioned emphasis of intensity as seen, for example, in the series of graphs at FIGS. 24*a* through 24*c*. And because all of the various pickup coils on an instrument might be located strategically across the span between the bridge and neck so as to produce a sound with a timbre that is a particular blend of fundamental and harmonics, and because a coil such as mini-coil 22 will represent its location within that span for only three strings in this example, it may combine strategically with another coil to also achieve a transition in timbre ("transition" here referring to string to string perception). For many years conventional pickups have been able to be combined to achieve blends of timbre and intensity, but it has always been the product of full coils combining with other full coils, and hence there has been no distinctive treatment for string groups or subsets. Because this invention provides for distinctive treatment of string groups or "subsets" or "tapered subsets" (or even a tapered full set), it is uniquely capable of creating composite sounds that represent transitions between string groups of both intensity and timbre simultaneously. It should again be noted that multiples of this apparatus and conventional pickups can be situated on the same instrument and combined in many variations to provide a wide variety of new and useful sounds. Various non-limiting examples are shown in FIGS. 25 through 29.

Aspects of the present specification may also be described as follows:

1. An apparatus for enhancing the output of a stringed musical instrument having a plurality of offset substantially parallel strings, the apparatus comprising a pickup assembly having tapered poles so as to incrementally vary the relative volume of adjacent strings.

2. The apparatus of embodiment 1 wherein the pickup assembly comprises both tapered and non-tapered poles, the non-tapered poles configured so as to produce substantially the same volume from adjacent strings.

3. The apparatus of embodiment 2 wherein: the non-tapered poles are positioned within at least one full coil configured to have one pole associated with each of the plurality of strings; and the tapered poles are positioned within at least one partial coil configured to have one pole associated with each of a subset of the plurality strings, the subset being fewer than the plurality of strings.

4. The apparatus of embodiment 3 wherein the full coil and the partial coil are mounted on a single assembly plate.

5. The apparatus of embodiment 4 wherein the partial coil is removably mounted on the assembly plate so as to be replaceable.

6. The apparatus of embodiment 5 wherein a non-coil cover is mounted in place of the partial coil.

7. The apparatus of any of embodiments 3-6 wherein the full coil and the partial coil are configured having independent outputs.

8. The apparatus of embodiment 7 wherein the partial coil output is configured with a dedicated partial coil switch.

9. The apparatus of any of embodiments 3-8 wherein the full coil is curved so as to increase the overall effective coil length thereof.

10. The apparatus of any of embodiments 3-9 wherein the partial coil is configured to nest immediately adjacent to the full coil.

11. The apparatus of any of embodiments 3-10 wherein: the full coil is configured having a top plate; and the pickup assembly further comprises a stabilizer configured to stabilize the top plate relative to an assembly plate on which the full coil is mounted.

12. The apparatus of any of embodiments 1-11 wherein the tapered poles taper toward center strings of the plurality of strings.

13. The apparatus of any of embodiments 1-12 wherein the tapered poles are tapered by physically setting the heights of pole pieces defining the poles in a descending array relative to associated strings of the plurality of strings.

14. The apparatus of embodiment 13 wherein the heights of the pole pieces are fixed.

15. The apparatus of embodiment 13 wherein the heights of the pole pieces are adjustable.

16. The apparatus of embodiment 15 wherein the pickup assembly further comprises an adjustment means selected from the group consisting of a riser bar, a set screw, a rocker bar, and any combination thereof.

17. The apparatus of any of embodiments 1-12 wherein the tapered poles are tapered by adjusting the output volumes of piezo crystal elements installed within a bridge of the stringed musical instrument so as to be associated with the plurality of strings and define the pickup assembly and the related tapered poles in a descending array as through a potentiometer.

18. The apparatus of any of embodiments 1-12 wherein the tapered poles are tapered by selecting a subset of frequencies through a capacitor and adjusting the amount of frequency filtering as through a connected potentiometer.

19. The apparatus of any of embodiments 1-18 wherein the tapered poles are positioned within a single pickup assembly comprising two partial coils each configured to have one pole associated with each of a subset of the plurality strings, the subset being fewer than the plurality of strings.

20. The apparatus of any of embodiments 1-19 comprising multiple pickup assemblies, at least one such pickup assembly having tapered poles.

21. The apparatus of embodiment 20 comprising a first pickup assembly comprising a first full coil having first non-tapered poles associated with each of the plurality of strings and a first partial coil having first tapered poles associated with each of a first subset of the plurality strings, the first subset being fewer than the plurality of strings.

22. The apparatus of embodiment 21 further comprising a second pickup assembly comprising a second full coil having second non-tapered poles associated with each of the plurality of strings and a second partial coil having second tapered poles associated with each of a second subset of the plurality strings, the second subset being fewer than the plurality of strings.

23. The apparatus of embodiment 22 wherein the first full coil and the second partial coil are connected and the second full coil and the first partial coil are connected.

24. The apparatus of embodiment 22 wherein the first partial coil and the second partial coil are connected separately through a respective first partial coil switch and second partial coil switch and the first full coil and the second full coil are connected commonly through a single full coil switch.

25. The apparatus of embodiment 24 wherein the first partial coil switch, the second partial coil switch, and the full coil switch are all connected to a single output jack.

26. The apparatus of embodiment 24 wherein the first partial coil switch is connected to a dedicated first partial coil output jack, the second partial coil switch is connected to a dedicated second partial coil output jack, and the full coil switch is connected to a dedicated full coil output jack.

27. The apparatus of any of embodiments 22-26 wherein the first and second subsets of the plurality of strings are different.

28. The apparatus of any of embodiments 22-27 wherein the first pickup assembly is located near a bridge of the stringed musical instrument and the second pickup assembly is located near a neck of the stringed musical instrument.

29. The apparatus of any of embodiments 21-28 wherein the first pickup assembly further comprises an additional first partial coil, wherein the first subsets of the plurality of strings of the respective first partial coils are different.

30. The apparatus of any of embodiments 21-29 further comprising a second pickup assembly and a separate third pickup assembly.

31. The apparatus of embodiment 30 wherein: the second pickup assembly comprises at least two second coils; and the third pickup assembly comprises at least one third coil.

32. The apparatus of embodiment 30 or embodiment 31 wherein the second and third coils are full coils having respective second and third non-tapered poles associated with each of the plurality of strings.

33. An apparatus for enhancing the output of a stringed musical instrument having a plurality of offset substantially parallel strings and at least one pickup assembly comprising both tapered and non-tapered poles, the non-tapered poles configured so as to produce substantially the same volume from the plurality of strings and the tapered poles configured so as to incrementally vary the relative volume of a subset of the plurality of strings in a descending array.

34. An apparatus for enhancing the output of a stringed musical instrument having a plurality of offset substantially parallel strings, the apparatus comprising: a first pickup assembly comprising a first full coil having first non-tapered poles associated with each of the plurality of strings and a first partial coil having first tapered poles associated with each of a first subset of the plurality strings, the first subset being fewer than the plurality of strings; and a second full coil having second non-tapered poles associated with each of the plurality of strings and a second partial coil having second tapered poles associated with each of a second subset of the plurality strings, the second subset being fewer than the plurality of strings, wherein the first and second subsets of the plurality of strings are different.

35. An apparatus for enhancing the output of a stringed musical instrument having a plurality of offset substantially parallel strings, the apparatus comprising a pickup assembly having at least one full coil configured to have one pole associated with each of the plurality of strings and at least one partial coil configured to have one pole associated with each of a subset of the plurality strings, the subset being fewer than the plurality of strings.

36. The apparatus of embodiment 35 wherein the full coil and the partial coil are mounted on a single assembly plate.

37. The apparatus of embodiment 36 wherein the partial coil is removably mounted on the assembly plate so as to be replaceable.

38. The apparatus of embodiment 37 wherein a non-coil cover is mounted in place of the partial coil.

39. The apparatus of any of embodiments 35-38 wherein the full coil and the partial coil are configured having independent outputs.

40. The apparatus of embodiment 39 wherein the partial coil output is configured with a dedicated partial coil switch.

41. The apparatus of any of embodiments 35-40 wherein the full coil is curved so as to increase the overall effective coil length thereof.

42. The apparatus of any of embodiments 35-41 wherein the partial coil is configured to nest immediately adjacent to the full coil.

43. The apparatus of any of embodiments 35-42 wherein: the full coil is configured having a top plate; and the pickup assembly further comprises a stabilizer configured to stabilize the top plate relative to an assembly plate on which the full coil is mounted.

44. The apparatus of any of embodiments 35-43 comprising multiple pickup assemblies.

45. The apparatus of embodiment 44 comprising a first pickup assembly comprising a first full coil associated with the plurality of strings and a first partial coil associated with a first subset of the plurality strings, the first subset being fewer than the plurality of strings.

46. The apparatus of embodiment 45 further comprising a second pickup assembly comprising a second full coil associated with the plurality of strings and a second partial coil associated with a second subset of the plurality strings, the second subset being fewer than the plurality of strings.

47. The apparatus of embodiment 46 wherein the first full coil and the second partial coil are connected and the second full coil and the first partial coil are connected.

48. The apparatus of embodiment 46 wherein the first partial coil and the second partial coil are connected separately through a respective first partial coil switch and second partial coil switch and the first full coil and the second full coil are connected commonly through a single full coil switch.

49. The apparatus of embodiment 48 wherein the first partial coil switch, the second partial coil switch, and the full coil switch are all connected to a single output jack.

50. The apparatus of embodiment 48 wherein the first partial coil switch is connected to a dedicated first partial coil output jack, the second partial coil switch is connected to a dedicated second partial coil output jack, and the full coil switch is connected to a dedicated full coil output jack.

51. The apparatus of any of embodiments 46-50 wherein the first and second subsets of the plurality of strings are different.

52. The apparatus of any of embodiments 46-51 wherein the first pickup assembly is located near a bridge of the stringed musical instrument and the second pickup assembly is located near a neck of the stringed musical instrument.

53. The apparatus of any of embodiments 45-52 wherein the first pickup assembly further comprises an additional first partial coil, wherein the first subsets of the plurality of strings of the respective first partial coils are different.

54. The apparatus of any of embodiments 45-53 further comprising a second pickup assembly and a separate third pickup assembly.

55. The apparatus of embodiment 54 wherein: the second pickup assembly comprises at least two second coils; and the third pickup assembly comprises at least one third coil.

56. The apparatus of embodiment 54 or embodiment 55 wherein the second and third coils are full coils having respective second and third non-tapered poles associated with each of the plurality of strings.

57. The apparatus of any of embodiments 35-56 comprising tapered poles in the at least one partial coil configured so as to incrementally vary the relative volume of adjacent strings.

58. The apparatus of any of embodiments 35-57 comprising non-tapered poles in the at least one full coil configured so as to produce substantially the same volume from adjacent strings.

59. A method of employing an output enhancement apparatus as defined in any of embodiments 1-58, the method comprising the steps of: (a) installing a pickup assembly on a stringed musical instrument adjacent to a plurality of strings thereof; (b) playing one or more of the plurality of strings; and (c) detecting the vibrations of the one or more played strings by an associated one or more poles of the pickup assembly.

60. A kit comprising an output enhancement apparatus as defined in any of embodiments 1-58.

61. Use of an output enhancing apparatus as defined in any of embodiments 1-58 to enhance the output of a stringed musical instrument.

62. The use according to embodiment 61, wherein the use comprises a method as defined in embodiment 59.

In closing, regarding the exemplary embodiments of the present invention as shown and described herein, it will be appreciated that an apparatus is disclosed and configured for enhancing the output of a stringed musical instrument. Because the principles of the invention may be practiced in a number of configurations beyond those shown and described, it is to be understood that the invention is not in any way limited by the exemplary embodiments, but is able to take numerous forms without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention.

Certain embodiments of the present invention are described herein, including the best mode known to the inventor(s) for carrying out the invention. Of course, variations on these described embodiments will become apparent to those of ordinary skill in the art upon reading the foregoing description. The inventor(s) expect skilled artisans to employ such variations as appropriate, and the inventor(s) intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques. Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as "first," "second," "third," etc.—for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples, or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

When used in the claims, whether as filed or added per amendment, the open-ended transitional term "comprising" (along with equivalent open-ended transitional phrases thereof such as "including," "containing" and "having") encompasses all the expressly recited elements, limitations, steps and/or features alone or in combination with un-recited subject matter; the named elements, limitations and/or features are essential, but other unnamed elements, limitations and/or features may be added and still form a construct within the scope of the claim. Specific embodiments disclosed herein may be further limited in the claims using the closed-ended transitional phrases "consisting of" or "consisting essentially of" in lieu of or as an amendment for "comprising." When used in the claims, whether as filed or added per amendment, the closed-ended transitional phrase "consisting of" excludes any element, limitation, step, or feature not expressly recited in the claims. The closed-ended transitional phrase "consisting essentially of" limits the scope of a claim to the expressly recited elements, limitations, steps and/or features and any other elements, limitations, steps and/or features that do not materially affect the basic and novel characteristic(s) of the claimed subject matter. Thus, the meaning of the open-ended transitional phrase "comprising" is being defined as encompassing all the specifically recited elements, limitations, steps and/or features as well as any optional, additional unspecified ones. The meaning of the closed-ended transitional phrase "consisting of" is being defined as only including those elements, limitations, steps and/or features specifically recited in the claim, whereas the meaning of the closed-ended transitional phrase "consisting essentially of" is being defined as only including those elements, limitations, steps and/or features specifically recited in the claim and those elements, limitations, steps and/or features that do not materially affect the basic and novel characteristic(s) of the claimed subject matter. Therefore, the open-ended transitional phrase "comprising" (along with equivalent open-ended transitional phrases thereof) includes within its meaning, as a limiting case, claimed subject matter specified by the closed-ended transitional phrases "consisting of" or "consisting essentially of." As such, embodiments described herein or so claimed with the phrase "comprising" are expressly or inherently unambiguously described, enabled and supported herein for the phrases "consisting essentially of" and "consisting of."

All patents, patent publications, and other publications referenced and identified in the present specification are individually and expressly incorporated herein by reference in their entirety for the purpose of describing and disclosing, for example, the compositions and methodologies described in such publications that might be used in connection with the present invention. These publications are provided solely for their disclosure prior to the filing date of the present application. Nothing in this regard should be construed as an admission that the inventors are not entitled to antedate such disclosure by virtue of prior invention or for any other reason. All statements as to the date or representation as to the contents of these documents is based on the information available to the applicants and does not constitute any admission as to the correctness of the dates or contents of these documents.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. An apparatus for enhancing the output of a stringed musical instrument having a plurality of offset substantially parallel strings, the apparatus comprising a pickup assembly having at least one set of tapered poles so as to incrementally vary the relative volume of adjacent strings as by the tapered poles being configured relative to associated strings of the plurality of strings in a descending array toward center strings of the plurality of strings, the pickup assembly further having at least one set of non-tapered poles configured so as to produce substantially the same volume from adjacent strings, wherein:

at least one of the tapered and non-tapered sets of poles is a full set having a pole associated with each of the plurality of strings; and at least one of the tapered and non-tapered sets of poles is a partial set having a pole associated with each of a subset of the plurality of strings, the subset being fewer than the plurality of strings but at least two strings.

2. The apparatus of claim 1 wherein:

the non-tapered poles define the full set and are positioned within at least one full coil configured to have one pole associated with each of the plurality of strings; and the tapered poles define the partial set and are positioned within at least one partial coil configured to have one pole associated with each of the subset of the plurality of strings.

3. The apparatus of claim 2 wherein the full coil and the partial coil are mounted on a single assembly plate.

4. The apparatus of claim 3 wherein the partial coil is removably mounted on the assembly plate so as to be replaceable.

5. The apparatus of claim 4 wherein a non-coil cover is mounted in place of the partial coil.

6. The apparatus of claim 2 wherein the full coil and the partial coil are configured having independent outputs.

7. The apparatus of claim 6 wherein the partial coil output is configured with a dedicated partial coil switch.

8. The apparatus of claim 2 wherein the full coil is curved so as to increase the overall effective coil length thereof.

9. The apparatus of claim 8 wherein the partial coil is configured to nest immediately adjacent to the full coil.

10. The apparatus of claim 2 wherein:

the full coil is configured having a top plate; and the pickup assembly further comprises a stabilizer configured to stabilize the top plate relative to an assembly plate on which the full coil is mounted.

11. The apparatus of claim 1 wherein the tapered poles are tapered by physically setting the heights of pole pieces defining the poles in the descending array.

12. The apparatus of claim 11 wherein the heights of the pole pieces are fixed.

13. The apparatus of claim 11 wherein the heights of the pole pieces are adjustable.

14. The apparatus of claim 13 wherein the pickup assembly further comprises an adjustment means selected from the group consisting of a riser bar, a set screw, a rocker bar, and any combination thereof.

15. The apparatus of claim 1 wherein the tapered poles are tapered by adjusting the output volumes of piezo crystal elements installed within a bridge of the stringed musical instrument so as to be associated with the plurality of strings and define the pickup assembly and the related tapered poles in the descending array as through a potentiometer.

16. The apparatus of claim 1 wherein the tapered poles are tapered by selecting a subset of frequencies through a capacitor and adjusting the amount of frequency filtering as through a connected potentiometer.

17. The apparatus of claim 1 wherein the tapered poles are positioned within a single pickup assembly comprising first and second partial coils each configured to have one pole associated with each of a respective first and second subset of the plurality of strings, the first and second subsets each being fewer than the plurality of strings but at least two strings.

18. The apparatus of claim 1 comprising multiple pickup assemblies, at least one such pickup assembly having tapered poles.

19. The apparatus of claim 18 comprising a first pickup assembly comprising a first full coil having first non-tapered poles associated with each of the plurality of strings and a first partial coil having first tapered poles associated with each of a first subset of the plurality of strings, the first subset being fewer than the plurality of strings but at least two strings.

20. The apparatus of claim 19 further comprising a second pickup assembly comprising a second full coil having second non-tapered poles associated with each of the plurality of strings and a second partial coil having second tapered poles associated with each of a second subset of the plurality of strings, the second subset being fewer than the plurality of strings but at least two strings.

21. The apparatus of claim 20 wherein the first full coil and the second partial coil are connected and the second full coil and the first partial coil are connected.

22. The apparatus of claim 20 wherein the first partial coil and the second partial coil are connected separately through a respective first partial coil switch and second partial coil switch and the first full coil and the second full coil are connected commonly through a single full coil switch.

23. The apparatus of claim 22 wherein the first partial coil switch, the second partial coil switch, and the full coil switch are all connected to a single output jack.

24. The apparatus of claim 22 wherein the first partial coil switch is connected to a dedicated first partial coil output jack, the second partial coil switch is connected to a dedicated second partial coil output jack, and the full coil switch is connected to a dedicated full coil output jack.

25. The apparatus of claim 20 wherein the first and second subsets of the plurality of strings are different.

26. The apparatus of claim 20 wherein the first pickup assembly is located near a bridge of the stringed musical instrument and the second pickup assembly is located near a neck of the stringed musical instrument.

27. The apparatus of claim 19 wherein the first pickup assembly further comprises an additional first partial coil, wherein the first subsets of the plurality of strings of the respective first partial coils are different.

28. The apparatus of claim 19 further comprising a second pickup assembly and a separate third pickup assembly.

29. The apparatus of claim 28 wherein:

the second pickup assembly comprises at least two second coils; and the third pickup assembly comprises at least one third coil.

30. The apparatus of claim 29 wherein the second and third coils are full coils having respective second and third non-tapered poles associated with each of the plurality of strings.

31. The apparatus of claim 1 wherein:

the tapered poles define the full set and are positioned within at least one full coil configured to have at least one pole associated with each of the plurality of strings; and the non-tapered poles define the partial set and are positioned within at least one partial coil configured to have one pole associated with each of the subset of the plurality of strings.

32. The apparatus of claim 31 wherein:

the full coil and the partial coil are configured having independent outputs; and the partial coil output is configured with a dedicated partial coil switch.

33. An apparatus for enhancing the output of a stringed musical instrument having a plurality of offset substantially parallel strings and at least one pickup assembly comprising at least one set of tapered poles and at least one set of non-tapered poles, the non-tapered poles configured so as to produce substantially the same volume from the plurality of strings and the tapered poles configured so as to incrementally vary the relative volume of a subset of the plurality of strings in a descending array, at least one of the sets of tapered and non-tapered poles being positioned within a curved full coil so as to increase the overall effective coil length thereof.

34. An apparatus for enhancing the output of a stringed musical instrument having a plurality of offset substantially parallel strings, the apparatus comprising:

a first pickup assembly comprising a first full coil having first non-tapered poles associated with each of the plurality of strings and a first partial coil having first tapered poles associated with each of a first subset of the plurality of strings, the first subset being fewer than the plurality of strings but at least two strings; and a second pickup assembly comprising a second full coil having second non-tapered poles associated with each of the plurality of strings and a second partial coil having second tapered poles associated with each of a second subset of the plurality of strings, the second subset being fewer than the plurality of strings but at least two strings, wherein the first and second subsets of the plurality of strings are different, and further wherein:

the first and second non-tapered poles of the respective first and second full coils are configured so as to produce substantially the same volume from adjacent strings of the plurality of strings; and the first and second tapered poles of the respective first and second partial coils are configured so as to incrementally vary the relative volume of adjacent strings as by each of the tapered poles being configured relative to the respective first and second subsets of the plurality of strings in a descending array toward center strings of the plurality of strings.

* * * * *